US007561998B2

(12) United States Patent
Panga et al.

(10) Patent No.: US 7,561,998 B2
(45) Date of Patent: Jul. 14, 2009

(54) MODELING, SIMULATION AND COMPARISON OF MODELS FOR WORMHOLE FORMATION DURING MATRIX STIMULATION OF CARBONATES

(75) Inventors: Mohan K. R. Panga, Kuala Lumpur (MY); Murtaza Ziauddin, Richmond, TX (US); Vemuri Balakotaiah, Bellaire, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 345 days.

(21) Appl. No.: 11/316,496

(22) Filed: Dec. 22, 2005

(65) Prior Publication Data

US 2006/0184346 A1 Aug. 17, 2006

Related U.S. Application Data

(60) Provisional application No. 60/650,831, filed on Feb. 7, 2005.

(51) Int. Cl.
*G06F 9/455* (2006.01)

(52) U.S. Cl. ..... 703/10; 166/281; 166/282

(58) Field of Classification Search ..... 703/9, 703/10; 166/281, 381, 250.1, 282, 60; 507/121, 507/244, 122, 124; 367/37
See application file for complete search history.

(56) References Cited

U.S. PATENT DOCUMENTS 6,030,928 A * 2/2000 Stahl et al. ..... 507/121
6,196,318 B1 3/2001 Gong et al.
6,436,880 B1 * 8/2002 Frenier ..... 507/244
6,637,517 B2 * 10/2003 Samuel et al. ..... 166/381
6,749,022 B1 * 6/2004 Fredd ..... 166/250.1
2003/0019627 A1 * 1/2003 Qu et al. ..... 166/281
2003/0225521 A1 12/2003 Panga et al.
2004/0045710 A1 * 3/2004 Fu et al. ..... 166/282
2004/0145969 A1 * 7/2004 Bai et al. ..... 367/37
2005/0092483 A1 * 5/2005 Vinegar et al. ..... 166/60

OTHER PUBLICATIONS

Wang, Y., Hill, A. D., and Schechter, R. S. "The Optimum Injection Rate for Matrix Acidizing of Carbonate Formations," paper SPE 26578 presented at 1993 SPE Annual Technical Conference and Exhibition held in Houston, Texas, Oct. 3-6, 1993.

(Continued)

*Primary Examiner*—Paul L Rodriguez
*Assistant Examiner*—Kandasmy Thangavelu
(74) *Attorney, Agent, or Firm*—David Cate; Rachel Greene; Robin Nava

(57) ABSTRACT

Disclosed are methods of modeling stimulation treatments, such as designing matrix treatments for subterranean formations penetrated by a wellbore, to enhance hydrocarbon recovery. The modeling methods describe the growth rate and the structure of the dissolution pattern formed due to the injection of a treatment fluid in a porous medium, based on calculating the length scales for dominant transport mechanism(s) and reaction mechanism(s) in the direction of flow $l_X$ and the direction transverse to flow $l_T$. Methods of the invention may further include introducing a treatment fluid into the formation, and treating the formation.

20 Claims, 18 Drawing Sheets
(2 of 18 Drawing Sheet(s) Filed in Color)

OTHER PUBLICATIONS

Buijse, M. A., "Understanding Wormholing Mechanisms Can Improve Acid Treatments in Carbonate Formations," SPE 65068 Prod. & Facilities, 15(3), 168-175, 2000.

Huang, T., Zhu, D. and Hill, A. D.: "Prediction of Wormhole Population Density in Carbonate Matrix Acidizing," paper SPE 54723 presented at the 1999 SPE European Formation Damage Conference held in The Hague, May 31-Jun. 1, 1999.

Hoefner M. L. and Fogler. H. S.: "Pore Evolution and Channel Formation During Flow and Reaction in Porous Media," AIChE J, 34, 45-54 (1988).

Fredd, C. N. and Fogler, H. S.: "Influence of Transport and Reaction on Wormhole Formation in Porous Media," AIChE J, 44, 1933-1949 (1998).

Pomès, V., Bazin, B., Golfier, F., Zarcone, C., Lenormand, R. and Quintard, M.: "On the Use of Upscaling Methods to Describe Acid Injection in Carbonates," paper SPE 71511 presented at 2001 SPE Annual Technical Conference and Exhibition held in New Orleans, Lousiana, Sep. 30-Oct. 3, 2001.

Golifier, F., Bazin, B., Zarcone, C., Lenormand, R., Lasseux, D. and Quintard, M.: "On the ability of a Darcy-scale model to capture wormhole formation during the dissolution of a porous medium," J. Fluid Mech., 457, 213-254 (2002).

Civan, Faruk, "Scale effect on Porosity and Permeability: Kinetics, Model and Correlation," AIChE J, 47, 271-287 (2001).

Gupta, N. and Balakotaiah, V.:"Heat and Mass Transfer Coefficients in Catalytic Monoliths,"Chem. Engg. Sci., 56, 4771-4786 (2001).

Balakotaiah, V. and West, D.H.: "Shape Normalization and Analysis of the Mass Transfer Controlled Regime in Catalytic Monoliths," Chem. Engg. Sci., 57,1269-1286 (2002.

Paccaloni, G. and Tambini, M.: "Advances in Matrix Stimulation Technology," J. Petrol. Tech, 256-263, Mar. 1993.

"From matrix Acidizing to Acid Fracturing: A Laboratory Evaluation of Acid/Rock Interactions," Feb. 2001, SPE 66566 Prod. & Facilities, 22-29, B. Bazin.

SPE 37312—Reaction Rate and Fluid Loss: The keys to Wormhole Initiation and Propagation in Carbonate Acidizing By T. Huang, A.D. Hill, R.S. Schechter.

SPE 59537—Dynamic Model to Wormhole Formation Demonstrates Conditions for Effective Skin Reduction During Carbonate Matrix Acidizing By C.N. Fredd.

"From matrix Acidizing to Acid Fracturing: A Laboratory Evaluation of Acid/Rock Interactions," Feb. 2001, SPE 66566 Prod. & Facilities, 22-29, B. Bazin, (2001).

SPE 37312—Reaction Rate and Fluid Loss: The keys to Wormhole Initiation and Propagation in Carbonate Acidizing By T. Huang, A.D. Hill, R.S. Schechter, (Feb. 1997).

SPE 59537—Dynamic Model of Wormhole Formation Demonstrates Conditions for Effective Skin Reduction During Carbonate Matrix Acidizing By C.N. Fredd, Mar. 2000.

* cited by examiner $$\Lambda_o^{-1} = \sqrt{\frac{Pe_L}{Da}}$$

MODELING, SIMULATION AND COMPARISON OF MODELS FOR WORMHOLE FORMATION DURING MATRIX STIMULATION OF CARBONATES

This patent application is a non-provisional application of provisional application Ser. No. 60/650,831 filed Feb. 7, 2005.

BACKGROUND

The present invention is generally related to hydrocarbon well stimulation, and is more particularly directed to methods for designing matrix treatments. The invention is particularly useful for modeling stimulation treatments, such as designing matrix treatments for subterranean formations penetrated by a wellbore, to enhance hydrocarbon recovery.

Matrix acidizing is a widely used well stimulation technique. The objective in this process is to reduce the resistance to the flow of reservoir fluids due from a naturally tight formation, or even to reduce the resistance to flow of reservoir fluids due to damage. Acid may dissolve the material in the matrix and create flow channels which increase the permeability of the matrix. The efficiency of such a process depends on the type of acid used, injection conditions, structure of the medium, fluid to solid mass transfer, reaction rates, etc. While dissolution increases the permeability, the relative increase in the permeability for a given amount of acid is observed to be a strong function of the injection conditions.

In carbonate reservoirs, depending on the injection conditions, multiple dissolution reaction front patterns may be produced. These patterns are varied, and may include uniform, conical, or even wormhole types. At very low injection rates, acid is spent soon after it contacts the medium resulting in face dissolution. The dissolution patterns are observed to be more uniform at high flow rates. At intermediate flow rates, long conductive channels known as wormholes are formed. These channels penetrate deep into the formation and facilitate the flow of oil. The penetration depth of the acid is restricted to a region very close to the wellbore. On the other hand, at very high injection rates, acid penetrates deep into the formation but the increase in permeability is not large because the acid reacts over a large region leading to uniform dissolution. For successful stimulation of a well it is desired to produce wormholes with optimum density and penetrating deep into the formation.

It is well known that the optimum injection rate to produce wormholes with optimum density and penetration depth into the formation depends on the reaction and diffusion rates of the acid species, concentration of the acid, length of the core sample, temperature, permeability of the medium, etc. The influence of the above factors on the wormhole formation is studied in the experiments. Several theoretical studies have been conducted in the past to obtain an estimate of the optimum injection rate and to understand the phenomena of flow channeling associated with reactive dissolution in porous media. However, existing models describe only a few aspects of the acidizing process and the coupling of the mechanisms of reaction and transport at various scales that play a key role in the estimation of optimum injection rate are not properly accounted for in existing models.

Studies are known where the goal has been to understand wormhole formation and to predict the conditions required for creating wormholes. In those experiments, acid was injected into a core at different injection rates and the volume of acid required to break through the core, also known as breakthrough volume, is measured for each injection rate. A common observation was dissolution creates patterns that are dependent on the injection rate. These dissolution patterns were broadly classified into three types: uniform, wormholing and face dissolution patterns corresponding to high, intermediate and low injection rates, respectively. It has also been observed that wormholes form at an optimum injection rate and because only a selective portion of the core is dissolved the volume required to stimulate the core is minimized. Furthermore, the optimal conditions for wormhole formation were observed to depend on various factors such as acid/mineral reaction kinetics, diffusion rate of the acid species, concentration of acid, temperature, and/or geometry of the system (linear/radial flow).

Network models describing reactive dissolution are known. These models represent the porous medium as a network of tubes interconnected to each other at the nodes. Acid flow inside these tubes is described using Hagen-Poiseuille relationship for laminar flow inside a pipe. The acid reacts at the wall of the tube and dissolution is accounted in terms of increase in the tube radius. Network models are capable of predicting the dissolution patterns and the qualitative features of dissolution like optimum flow rate, observed in the experiments. However, a core scale simulation of the network model requires enormous computational power and incorporating the effects of pore merging and heterogeneities into these models is difficult. The results obtained from network models are also subject to scale up problems.

An intermediate approach to describing reactive dissolution involves the use of averaged or continuum models. Averaged models were used to describe the dissolution of carbonates. Unlike the network models that describe dissolution from the pore scale and the models based on the assumption of existing wormholes, the averaged models describe dissolution at a scale much larger than the pore scale and much smaller than the scale of the core. This intermediate scale is also known as the Darcy scale.

Averaged models circumvent the scale-up problems associated with network models, can predict wormhole initiation, propagation and can be used to study the effects of heterogeneities in the medium on the dissolution process. The results obtained from the averaged models can be extended to the field scale. The success of these models depends on the key inputs such as mass transfer rates, permeability-porosity correlation etc., which depend on the processes that occur at the pore scale. The averaged model written at the Darcy scale requires these inputs from the pore scale. Since the structure of the porous medium evolves with time, a pore level calculation has to be made at each stage to generate inputs for the averaged equation. Averaged equations used in such models describe the transport of the reactant at the Darcy scale with a pseudo-homogeneous model, i.e., they use a single concentration variable. In addition, they assume that the reaction is mass transfer controlled (i.e. the reactant concentration at the solid-fluid interface is zero). However, the models developed thus far describe only a few aspects of the acidization process and the coupling between reaction and transport mechanisms that plays a key role in reactive dissolution is not completely accounted for in these models. Most systems fall in between the mass transfer and kinetically controlled regimes of reaction where the use of a pseudo-homogeneous model (single concentration variable) is not sufficient to capture all the features of the reactive dissolution process qualitatively and that 'a priori' assumption that the system is in the mass transfer controlled regime, often made in the literature, may not retain the qualitative features of the problem.

It would therefore be desirable to provide improved averaged models based upon a plurality of scales which describe the influence of different factors affecting acidizing fluid reaction and transport in wormhole formation during matrix stimulation of carbonates, and such need is met, at least in part, by the following invention.

SUMMARY OF THE INVENTION

Disclosed are methods of modeling stimulation treatments, such as designing matrix treatments for subterranean formations penetrated by a wellbore, to enhance hydrocarbon recovery.

Methods of the invention provide a multiple scale continuum models to describe transport and reaction mechanisms in reactive dissolution of a porous medium and used to study wormhole formation during acid stimulation of carbonate cores. The model accounts for pore level physics by coupling local pore scale phenomena to macroscopic operating variables (such as, by non-limiting example, Darcy velocity, pressure, temperature, concentration, fluid flow rate, rock type, etc.) through structure-property relationships (such as, by non-limiting example, permeability-porosity, average pore size-porosity, etc.), and the dependence of mass transfer and dispersion coefficients on evolving pore scale variables (i.e. average pore size and local Reynolds and Schmidt numbers). The gradients in concentration at the pore level caused by flow, species diffusion and chemical reaction are described using two concentration variables and a local mass transfer coefficient. Numerical simulations of the model on a two-dimensional domain show that the model captures dissolution patterns observed in the experiments. A qualitative criterion for wormhole formation is given by ?~O(1), where $\Lambda=\sqrt{k_{eff}D_{eT}}/u_o$. $k_{eff}$ is the effective volumetric first-order rate constant, $D_{eT}$ is the transverse dispersion coefficient and $u_o$ is the injection velocity.

In some embodiments, methods of modeling a subterranean formation stimulation treatment involving a chemical reaction in a porous medium include describing the growth rate and the structure of the dissolution pattern formed due to the injection of a treatment fluid in a porous medium, based on calculating the length scales for dominant transport mechanism(s) and reaction mechanism(s) in the direction of flow $l_X$ and the direction transverse to flow $l_T$. The growth rate and the structure of the dissolution pattern is described as function of $l_X$ and $l_T$, as follows:

$$\Lambda = \frac{l_T}{l_X} = \frac{\sqrt{k_{eff} D_{eT}}}{u_{tip}}$$

where $k_{eff}$ is the effective rate constant, ($D_{eT}$) is the effective transverse dispersion coefficient, and $u_{tip}$ is the velocity of the fluid at the tip of the wormhole. The optimum rate for the formation of wormholes is computed by setting $\Lambda$ in the range $0.1<\Lambda<5$; flow rate for uniform dissolution is computed by setting $\Lambda<0.001$; or, flow rate for face dissolution is computed by setting $\Lambda>5$.

In another embodiment of the invention, a method of modeling a subterranean formation stimulation treatment involving a chemical reaction in a porous carbonate medium includes describing the growth rate and the structure of a wormhole pattern formed due to the injection of a treatment fluid into the medium, based on calculating the length scales for convection and/or dispersion transport mechanism(s) and heterogeneous reaction mechanism in the direction of flow $l_X$ and the direction transverse to flow $l_T$.

Methods of the invention may also include introducing a treatment fluid into the formation, and treating the formation, based upon models.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION OF SOME EMBODIMENTS OF THE INVENTION

Figure 1:
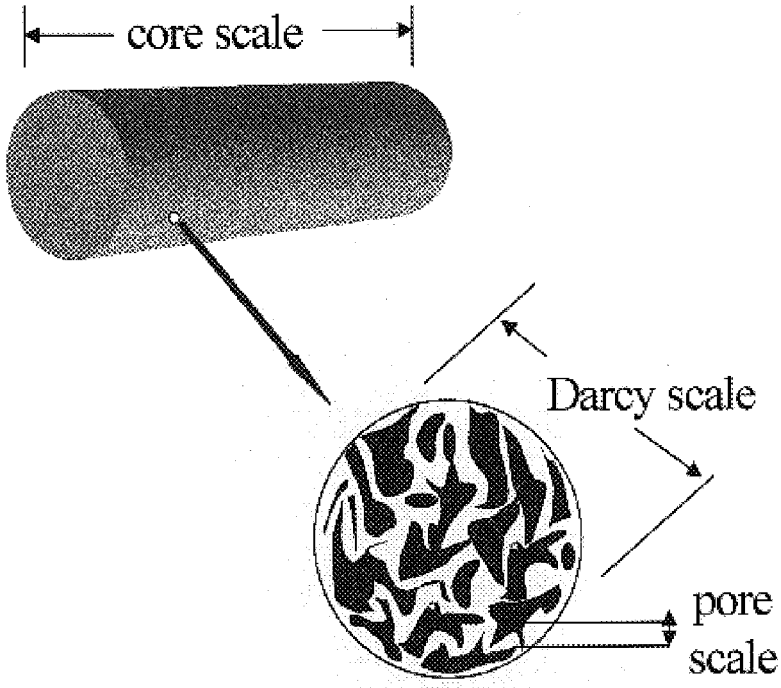
FIG. 1 is a schematic of different length scales used in some models according to the invention.

Illustrative embodiments of the invention are described below. In the interest of clarity, not all features of an actual implementation are described in this specification. It will of course be appreciated that in the development of any such actual embodiment, numerous implementation specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

The invention relates to hydrocarbon well stimulation, and is more particularly directed to methods of modeling subterranean formation stimulation treatment, such as designing matrix treatments for subterranean formations penetrated by a wellbore, to enhance hydrocarbon recovery. Inventors have discovered that multiple scale continuum models describing transport and reaction mechanisms in reactive dissolution of a porous medium may be used to evaluate wormhole formation during acid stimulation of carbonate cores. The model accounts for pore level physics by coupling local pore scale phenomena to macroscopic operating variables (such as, by non-limiting example, Darcy velocity, pressure, temperature, concentration, fluid flow rate, rock type, etc.) through structure-property relationships (such as, by non-limiting example, permeability-porosity, average pore size-porosity etc.), and the dependence of mass transfer and dispersion coefficients on evolving pore scale variables (i.e. average pore size and local Reynolds and Schmidt numbers). The gradients in concentration at the pore level caused by flow, species diffusion and chemical reaction are described using two concentration variables and a local mass transfer coefficient. Numerical simulations of the model on a two-dimensional domain show that the model captures dissolution patterns observed in the experiments. A qualitative criterion for wormhole formation is developed and it is given by ?~O(1), where $\Lambda=\sqrt{k_{eff}D_{eT}}/u_o$. Here, $k_{eff}$ is the effective volumetric first-order rate constant, $D_{eT}$ is the transverse dispersion coefficient and $u_o$ is the injection velocity. Models may be used to examine the influence of the level of dispersion, the heterogeneities present in the core, thermodynamic and/or kinetic reaction mechanisms, and mass transfer on wormhole formation.

Some embodiments of the invention are suitable for modeling acid treatments of carbonate subterranean formations, such as matrix acidizing and acid fracturing. By carbonate formations, it is meant those formations substantially formed of carbonate based minerals, including, by non-limiting example, calcite, dolomite, quartz, feldspars, clays, and the like, or any mixture thereof. Treatment fluids useful in matrix acidizing or acid fracturing may include any suitable materials useful to conduct wellbore and subterranean formation treatments, including, but not necessarily limited to mineral acids (i.e. HCl, HF, etc.), organic acids (such as formic acid, acetic acid, and the like), chelating agents (such as EDTA, DTPA, ant the like), polymers, surfactants, or any mixtures thereof. Methods of the invention are not necessarily limited modeling acidizing treatment of carbonate subterranean formations, such as matrix acidizing and acid fracturing treatments, but may also include introducing a treatment fluid into the formation, and subsequently treating the formation.

Apart from well/formation stimulation, the problem of reaction and transport in porous media also appears in packed-beds, pollutant transport in ground water, tracer dispersion, etc. The presence of various length scales and coupling between the processes occurring at different scales is a common characteristic that poses a big challenge in modeling these systems. For example, the dissolution patterns observed on the core scale are an outcome of the reaction and diffusion processes occurring inside the pores, which are of microscopic dimensions. To capture these large-scale features, efficient transfer of information on pore scale processes to larger length scales may become important. In addition to the coupling between different length scales, the change in structure of the medium adds an extra dimension of complexity in modeling systems involving dissolution. The model of the present invention improves the averaged models by taking into account the fact that the reaction can be both mass transfer and kinetically controlled, which is notably the case with relatively slow-reacting chemicals such as chelants, while still authorizing that pore structure may vary spatially in the domain due, for instance, to heterogeneities and dissolution.

According to another embodiment of the invention, both the asymptotic/diffusive and convective contributions are accounted to the local mass transfer coefficient. This allows predicting transitions between different regimes of reaction.

In acid treatment of carbonate reservoirs, the reaction between a carbonate porous medium and acid leads dissolution of the medium, thereby increasing the permeability to a large value. At very low injection rates in a homogeneous medium, this reaction may give rise to a planar reaction/dissolution front where the medium behind the front is substantially dissolved, and the medium ahead of the front remains undissolved. The presence of natural heterogeneities in the medium can lead to an uneven increase in permeability along the front, thus leading to regions of high and low permeabilities. The high permeability regions attract more acid which further dissolves the medium creating channels that travel ahead of the front. Thus, adverse mobility, known as $K/\mu$, where K is the permeability and $\mu$ is the viscosity of the fluid, arising due to differences in permeabilities of the dissolved and undissolved medium, and heterogeneity are required for channel formation.

Reaction-driven instability has been studied using linear and weakly nonlinear stability analyses. The instability is similar to the viscous fingering instability where adverse mobility arises due to a difference in viscosities of the displacing and displaced fluids incorporated herein. The shape (wormhole, conical, etc.) of the channels is, however, dependent on the relative magnitudes of convection and dispersion in the medium. For example, when transverse dispersion is more dominant than convective transport, reaction leads to conical and face dissolution patterns. Conversely, when convective transport is more dominant, the concentration of acid is more uniform in the domain leading to a uniform dissolution pattern. Models according to the invention here describe the phenomena of reactive dissolution as a coupling between processes occurring at two scales, namely the Darcy scale and the pore scale.

A schematic of both the Darcy and the pore length scales is shown in FIG. 1. The two scale model for reactive dissolution is valid for any practical geometries, including both linear flow geometry (such as is a core test or fracture), and radially flow geometry (such as flow from a wellbore into a formation). The two scale model is given by Equations (1-5).

$$U = -\frac{1}{\mu}\mathcal{K}\nabla P \tag{1}$$

$$\frac{\partial \varepsilon}{\partial t}\nabla \cdot \mathcal{J} 0 \tag{2}$$

$$\varepsilon\frac{\partial C_f}{\partial t} + \mathcal{J}\nabla \cdot C_f = \nabla(\varepsilon\mathcal{D}_e \nabla C_f) - k_c a_v(C_f - C_s) \tag{3}$$

$$k_c a_v(C_f - C_s) = R(C_s) \tag{4}$$

-continued $$\frac{\partial \varepsilon}{\partial t} = \frac{R(C_s)a_v\alpha}{\rho_s} \tag{5}$$

Here U=(U, V, W) is the Darcy velocity vector, K is the permeability tensor, P is the pressure, $\epsilon$ is the porosity, $C_f$ is the cup-mixing concentration of the acid in the fluid phase, $C_s$ is the concentration of the acid at the fluid-solid interface, $D_e$ is the effective dispersion tensor, $k_c$ is the local mass transfer coefficient, $a_v$ is the interfacial area available for reaction per unit volume of the medium, $?_s$ is the density of the solid phase, and a is the dissolving power of the acid, defined as grams of solid dissolved per mole of acid reacted. The reaction mechanism is represented by $R(C_s)$. For a first order reaction $R(C_s)$ reduces to $k_sC_s$ where $k_s$ is the surface reaction rate constant having the units of velocity. The reaction mechanism(s) may include reactions between the components of the injected fluid and the porous medium.

Equation (3) gives Darcy scale description of the transport of acid species. The first three terms in the equation represent the accumulation, convection and dispersion of the acid respectively. The fourth term describes the transfer of the acid species from the fluid phase to the fluid-solid interface and its role is discussed in detail later in this section. The velocity field U in the convection term is obtained from Darcy's law (Equation (1)) relating velocity to the permeability field K and gradient of pressure. Darcy's law gives a good estimate of the flow field at low Reynolds number. For flows with Reynolds number greater than unity, the Darcy-Brinkman formulation, which includes viscous contribution to the flow, may be used to describe the flow field. Though the flow rates of interest here have Reynolds number less than unity, change in permeability field due to dissolution can increase the Reynolds number above unity. The Darcy's law, computationally less expensive than the Darcy-Brinkman formulation, may be used for the present invention, though the model can be easily extended to the Brinkman formulation. The first term in the continuity Equation (2) accounts for the effect of local volume change during dissolution on the flow field. While deriving the continuity equation, it is assumed that the dissolution process does not change the fluid phase density significantly.

The transfer term in the species balance Equation (3) describes the depletion of the reactant at the Darcy scale due to reaction. An accurate estimation of this term depends on the description of transport and reaction mechanisms inside the pores. Hence a pore scale calculation on the transport of acid species to the surface of the pores and reaction at the surface is required to calculate the transfer term in Equation (3). In the absence of reaction, the concentration of the acid species is uniform inside the pores. Reaction at the solid-fluid interface gives rise to concentration gradients in the fluid phase inside the pores. The magnitude of these gradients depends on the relative rate of mass transfer from the fluid phase to the fluid-solid interface and reaction at the interface. If the reaction rate is very slow compared to the mass transfer rate, the concentration gradients are negligible. In this case the reaction is considered to be in the kinetically controlled regime and a single concentration variable is sufficient to describe this situation. However, if the reaction rate is very fast compared to the mass transfer rate, steep gradients develop inside the pores. This regime of reaction is known as mass transfer controlled regime. To account for the gradients developed due to mass transfer control requires the solution of a differential equation describing diffusion and reaction mechanisms inside each of the pores. Since this is not practical, two concentration variables, $C_s$ and $C_f$, are used. One variable, $C_s$, is for the concentration of the acid at fluid-solid interface, and the other, $C_f$, for the concentration in the fluid phase. This may be utilized to capture the information contained in the concentration gradients as a difference between the two variables using the concept of mass transfer coefficient (Equation (4)).

Mathematical representation of the transfer between the fluid phase and fluid-solid interface using two concentration variables and reaction at the interface is shown in Equation (4). The left hand side of the equation represents the transfer between the phases using the difference between the concentration variables and mass transfer coefficient $k_c$. The amount of reactant transferred to the surface is equated to the amount reacted. For the case of first order kinetics ($R(C_s)=k_sC_s$) Equation (4) can be simplified to $$C_s = \frac{C_f}{1 + \frac{k_s}{k_c}} \tag{6}$$

In the kinetically controlled regime, the ratio of $k_s/k_s$ is very small and the concentration at the fluid-solid interface is approximately equal to the concentration of the fluid phase ($C_s \sim C_f$). The ratio of $k_s/k_c$ is very large in the mass transfer controlled regime. In this regime, the value of concentration at the fluid-solid interface (Equation (6)) is very small ($C_s \sim 0$). Since the rate constant is fixed for a given acid, the magnitude of the ratio $k_s/k_c$ is determined by the local mass transfer coefficient $k_c$, which is a function of the pore geometry, the reaction rate, and the local hydrodynamics. Due to dissolution and heterogeneity in the medium, the ratio $k_s/k_c$ is not a constant in the medium but varies with space and time which can lead to a situation where different locations in the medium experience different regimes of reaction. To describe such a situation it is essential to account for both kinetic and mass transfer controlled regimes in the model, which is attained here using two concentration variables. A single concentration variable is not sufficient to describe both the regimes simultaneously. Equation (5) describes the evolution of porosity in the domain due to reaction.

The two-scale model can be extended to the case of complex kinetics by introducing the appropriate form of reaction kinetics $R(C_s)$ in Equation (4). If the kinetics are nonlinear, equation (4) becomes a nonlinear algebraic equation which has to be solved along with the species balance equation. For reversible reactions, the concentration of the products affects the reaction rate, thus additional species balance equations describing the product concentration must be added to complete the model in the presence of such reactions. The change in local porosity is described with porosity evolution Equation (5). This equation is obtained by balancing the amount of acid reacted to the corresponding amount of solid dissolved.

To complete the model Equations (1-5), information on permeability tensor K, dispersion tensor $D_e$, mass transfer coefficient $k_c$ and interfacial area $a_v$ is required. These quantities depend on the pore structure and are inputs to the Darcy scale model from the pore scale model. Instead of calculating these quantities from a detailed pore scale model taking into consideration the actual pore structure, inventors have unexpectedly realized that the structure-property relations that relate permeability, interfacial area, and average pore radius of the pore scale model to its porosity may be used. In embodiments of the invention, structure-property relations are used to study the trends in the behavior of dissolution for different types of structure-property relations and to reduce the computational effort involved in a detailed pore scale calculation.

Pore Scale Model

Structure-Property Relations

Dissolution changes the structure of the porous medium continuously, thus making it difficult to correlate the changes in local permeability to porosity during acidization. The results obtained from averaged models, which use these correlations, are subject to quantitative errors arising from the use of poor correlation between the structure and property of the medium, though the qualitative trends predicted may be correct. Since a definitive way of relating the change in the properties of the medium to the change in structure during dissolution does not exist, semi-empirical relations that relate the properties to local porosity may be utilized. The relative increase in permeability, pore radius and interfacial area with respect to their initial values are related to porosity in the following manner:

$$\frac{K}{K_o} = \frac{\varepsilon}{\varepsilon_o}\left(\frac{\varepsilon(1-\varepsilon_o)}{\varepsilon_o(1-\varepsilon)}\right)^{2\beta}, \tag{7}$$

$$\frac{r_p}{r_o} = \sqrt{\frac{K\varepsilon_o}{K_o\varepsilon}} \text{ and} \tag{8}$$

$$\frac{a_v}{a_o} = \frac{\varepsilon r_o}{\varepsilon_o r_p}. \tag{9}$$

Figure 2:
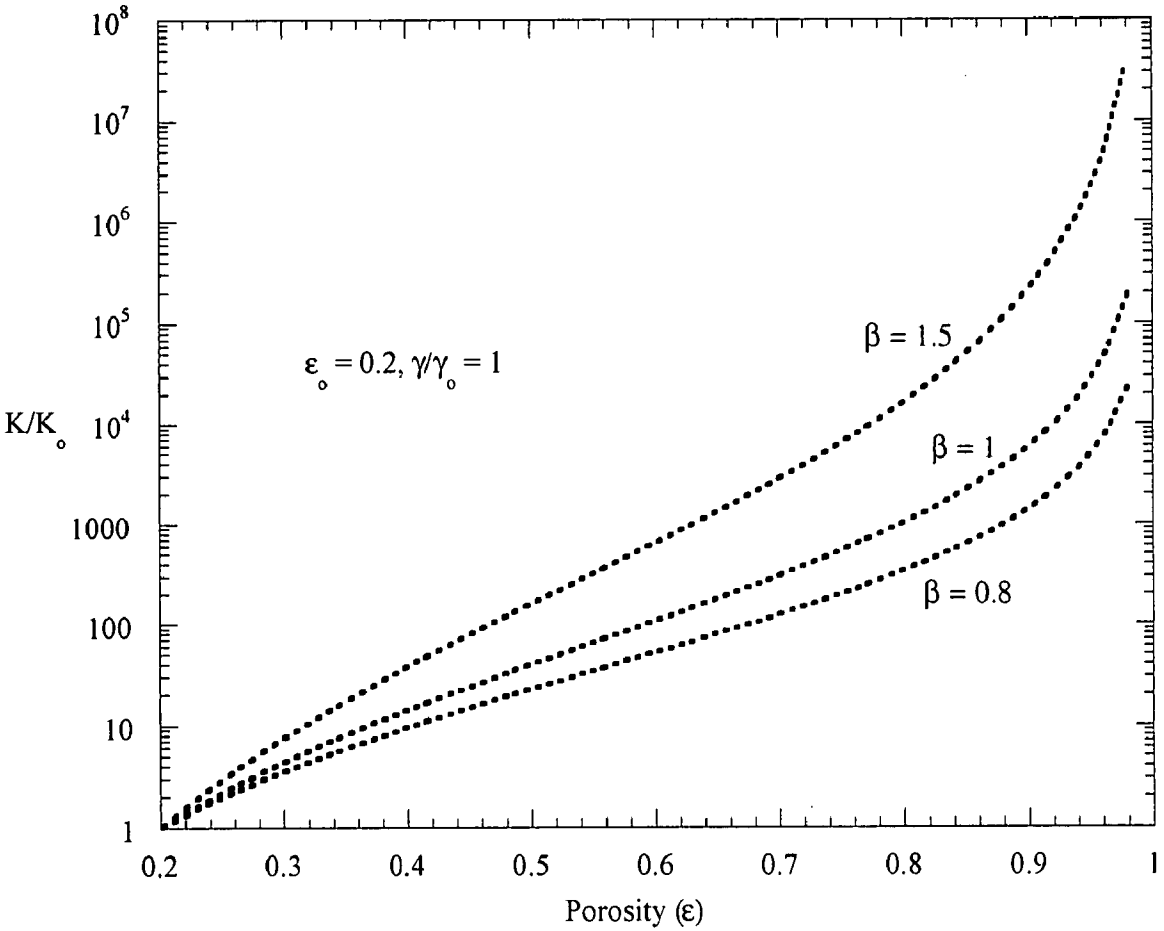
FIG. 2 is a plot showing variation of permeability with porosity for different values of β.

Here $K_o$, $r_o$ and $a_o$ are the initial values of permeability, average pore radius and interfacial area, respectively. FIG. 2 shows a typical plot of permeability versus porosity for different values of the parameter β. In addition, the effect of structure-property relations on breakthrough time has also been tested by using different correlations described below. The model yields optimal results if structure-property correlations that are developed for a particular system of interest are used. Note that, in the above relations, permeability, which is a tensor, is reduced to a scalar for the pore scale model. In the case of anisotropic permeability, extra relations for the permeability of the pore scale model are needed to complete the model.

Mass Transfer Coefficient

The rate of transport of acid species from the fluid phase to the fluid-solid interface inside the pores is quantified by the mass transfer coefficient. It plays an important role in characterizing dissolution phenomena because mass transfer coefficient determines the regime of reaction for a given acid (Equation (6)). The local mass transfer coefficient depends on the local pore structure, reaction rate and local velocity of the fluid. The contribution of each of these factors to the local mass transfer coefficient is investigated in detail in references in Gupta, N. and Balakotaiah, V.: "*Heat and Mass Transfer Coefficients in Catalytic Monoliths*," Chem. Eng. Sci., 56, 4771-4786 (2001) and in Balakotaiah, V. and West, D. H.: "*Shape Normalization and Analysis of the Mass Transfer Controlled Regime in Catalytic Monoliths*," Chem. Eng. Sci., 57, 1269-1286 (2002).

For developing flow inside a straight pore of arbitrary cross section, a good approximation to the Sherwood number, the dimensionless mass transfer coefficient, is given by $$Sh = \frac{2k_c r_p}{D_m} = Sh_\infty + 0.35\left(\frac{d_h}{x}\right)^{0.5} Re_p^{1/2} Sc^{1/3} \tag{10}$$

where $k_c$ is the mass transfer coefficient, $r_p$ is the pore radius and $D_m$ is molecular diffusivity, $Sh_8$ is the asymptotic Sherwood number for the pore, $Re_p$ is the pore Reynolds number, $d_h$ is the pore hydraulic diameter, x is the distance from the pore inlet and Sc is the Schmidt number (Sc=?/$D_m$; where ? is the kinematic viscosity of the fluid). Assuming that the length of a pore is typically a few pore diameters, the average mass transfer coefficient can be obtained by integrating the above expression over a pore length and is given by $$Sh = Sh_\infty + bRe_p^{1/2}Sc^{1/3} \tag{11}$$

where the constants $Sh_8$ and b (=0.7/$m^{0.5}$), m=pore length to diameter ratio) depend on the structure of the porous medium (pore cross sectional shape and pore length to hydraulic diameter ratio). Equation (11) is of the same general form as the Frossling correlation used extensively in correlating mass transfer coefficients in packed-beds. For a packed bed of spheres, $Sh_8$=2 and b=0.6, this value of b is close to the theoretical value of 0.7 predicted by Equation (11) for m=1.

The two terms on the right hand side in correlation (11) are contributions to the Sherwood number due to diffusion and convection of the acid species, respectively. While the diffusive part, $Sh_8$, depends on the pore geometry, the convective part is a function of the local velocity. The asymptotic Sherwood number for pores with cross sectional shape of square, triangle and circle are 2.98, 2.50 and 3.66, respectively. Since the value of asymptotic Sherwood number is a weak function of the pore geometry, a typical value of 3.0 may be used for the calculations. The convective part depends on the pore Reynolds number and the Schmidt number. For liquids, the typical value of Schmidt number is around one thousand and assuming a value of 0.7 for b, the approximate magnitude of the convective part of Sherwood number from Equation (11) is $7Re_p^{1/2}$. The pore Reynolds numbers are very small due to the small pore radius and the low injection velocities of the acid, making the contribution of the convective part negligible during initial stages of dissolution. As dissolution proceeds, the pore radius and the local velocity increase, making the convective contribution significant. Inside the wormhole, where the velocity is much higher than elsewhere in the medium, the pore level Reynolds number is high and the magnitude of the convective part of the Sherwood number could exceed the diffusive part. The effect of this change in mass transfer rate due to convection on the acid concentration may not be significant because of the extremely low interfacial area in the high porosity regions. The acid could be simply convected forward without reacting due to low interfacial area by the time the convection contribution to the mass transfer coefficient becomes important. Though the effect of convective part of the mass transfer coefficient on the acid concentration inside the wormhole is expected to be negligible, it is important in the uniform dissolution regime and to study the transitions between different reaction regimes occurring in the medium due to change in mass transfer rates.

The effect of reaction kinetics on the mass transfer coefficient is observed to be weak. For example, the asymptotic Sherwood number varies from 48/11 (=4.36) to 3.66 for the case of very slow reaction to very fast reaction. The correlation (12) accounts for effect of the three factors, pore cross sectional shape, local hydrodynamics and reaction kinetics on the mass transfer coefficient. The influence of tortuosity of the pore on the mass transfer coefficient is not included in the correlation. Intuitively, the tortuosity of the pore contributes towards the convective part of the Sherwood number. However, as mentioned above, the effect of convective part of the mass transfer coefficient on the acid concentration profile is negligible and does not affect the qualitative behavior of dissolution.

Fluid Phase Dispersion Coefficient

For homogeneous, isotropic porous media, the dispersion tensor is characterized by two independent components, namely, the longitudinal, $D_{eX}$ and transverse, $D_{eT}$, dispersion coefficients. In the absence of flow, dispersion of a solute occurs only due to molecular diffusion and $D_{eX}=D_{eT}=a_oD_m$, where $D_m$ is the molecular diffusion coefficient and $a_o$ is a constant that depends on the structure of the porous medium (e.g., tortuosity). With flow, the dispersion tensor depends on the morphology of the porous medium as well as the pore level flow and fluid properties. In general, the problem of relating the dispersion tensor to these local variables is rather complex and is analogous to that of determining the permeability tensor in Darcy's law from the pore structure. According to a preferred embodiment of the present invention, only simple approximations to the dispersion tensor are considered.

The relative importance of convective to diffusive transport at the pore level is characterized by the Peclet number in the pore, defined by $$Pe = \frac{\text{?}|d_h}{D_m} \tag{12}$$

where |u| is the magnitude of the Darcy velocity and $d_h$ is the pore hydraulic diameter. For a well-connected pore network, random walk models and analogy with packed beds may be used to show that $$\frac{D_{eX}}{D_m} = \alpha_o + \lambda_X Pe \tag{13}$$

$$\frac{D_{eT}}{D_m} = \alpha_o + \lambda_T Pe \tag{14}$$

where $?_X$ and $?_T$ are numerical coefficients that depend on the structure of the medium ($?_X$~0.5, $?_T$~0.1 for packed-beds). Other correlations used for $D_{eX}$ are of the form $$\frac{D_{eX}}{D_m} = \alpha_o + \frac{1}{6} Pe \ln\left(\frac{3Pe}{2}\right) \tag{15}$$

$$\frac{D_{eT}}{D_m} = \alpha_o + \lambda_T Pe^2 \tag{16}$$

Equation (16) is based on Taylor-Aris theory is normally used when the connectivity between the pores is very low. These as well as the other correlations in literature predict that both the longitudinal and transverse dispersion coefficients increase with the Peclet number. According to an embodiment of the present invention, the simpler relation given by Equations (13) and (14) is used to complete the averaged model. In the following sections, the 1-D and 2-D versions of the two-scale model (1-5) are analyzed.

TABLE 1

Pore Level Peclet numbers at different injection rates.

| Regime | Injection Velocity (cm/s) | $Pe_p$ |
|---|---|---|
| Face | $1.4 \times 10^{-4}$ | $7 \times 10^{-4}$ |
| Wormhole | $1.4 \times 10^{-3}$ | $7 \times 10^{-3}$ |
| Uniform | 0.14 | 0.7 |

Table 1 shows typical values of pore Peclet numbers calculated based on the core experiments (permeability of the cores is approximately 1 mD) listed in Fredd, C. N. and Fogler, H. S.: "*Influence of Transport and Reaction on Wormhole Formation in Porous Media*," AIChE J, 44, 1933-1949 (1998). The injection velocities of the acid (0.5M hydrochloric acid) are varied between 0.14 cm/s and $1.4\times10^{-4}$ cm/s, where 0.14 cm/s corresponds to the uniform dissolution regime and $1.4\times10^{-4}$ cm/s corresponds to the face dissolution regime. The values of pore diameter, molecular diffusion and porosity used in the calculations are 0.1 μm, $2\times10^{-5}$ cm2/s and 0.2, respectively. It appears from the low values of pore level Peclet number in the face dissolution regime that dispersion in this regime is primarily due to molecular diffusion. The Peclet number is close to order unity in the uniform dissolution regime showing that both molecular and convective contributions are of equal order. In the numerical simulations it is observed that the dispersion term in Equation (3) does not play a significant role at high injection rates (uniform dissolution regime) where convection is the dominant mechanism. As a result, the form of the convective part of the dispersion coefficient ($?_X Pe_p$, $Pe_p$ ln(3 $Pe_p$/2), etc.), which becomes important in the uniform dissolution regime, may not affect the breakthrough times at low permeabilities. The dispersion relations given by Equations (13) and (14) may be used to complete the averaged model.

Dimensionless Model Equations and Limiting Cases

The model equations for first order irreversible kinetics are made dimensionless for the case of constant injection rate at the inlet boundary by defining the following dimensionless variables:

$$x = \frac{x'}{L},\ y = \frac{y'}{L},\ z = \frac{z'}{L},\ u = \frac{U}{u_o},\ t = \frac{t}{(L/u_o)},$$

$$r = \frac{r_p}{r_o},\ A_v = \frac{a_v}{a_o},\ \kappa = \frac{K}{K_o},\ c_f = \frac{C_f}{C_o},\ c_s = \frac{C_s}{C_o},\ p = \frac{P - P_e}{\frac{\mu u_o L}{K_o}}$$

$$\phi^2 = \frac{2k_s r_o}{D_m},\ Da = \frac{k_s a_o L}{u_o},\ N_{ac} = \frac{\alpha C_o}{\rho_s},\ Pe_L = \frac{u_o L}{D_m},\ \eta = \frac{2r_o}{L},\ \alpha_o = \frac{H}{L}$$

where L is the characteristic length scale in the (flow) x' direction, H is the height of the domain, $u_o$ is the inlet velocity, $C_o$ is the inlet concentration of the acid and $P_e$ is the pressure at the exit boundary of the domain. The initial values of permeability, interfacial area and average pore radius are represented by $K_o$, $a_o$ and $r_o$, respectively. The parameters obtained after making the equations dimensionless are the (pore scale) Thiele modulus $F^2$, the Damköhler number Da, the acid capacity number $N_{ac}$, the axial Peclet number $Pe_L$, aspect ratio $a_o$, and ?.

The Thiele modulus ($F^2$) is defined as the ratio of diffusion time to reaction time based on the initial pore size and the Damköhler number (Da) is defined as the ratio of convective time to reaction time based on the length scale of the core. The acid capacity number ($N_{ac}$) is defined as the volume of solid dissolved per unit volume of the acid and the axial Peclet number $Pe_L$ is the ratio of axial diffusion time to convection time. Notice that in the above parameters, inlet velocity $u_o$ appears in two parameters Da and $Pe_L$. To eliminate inlet velocity from one of the parameters, so that the variable of interest (i.e. injection velocity) appears in only one dimensionless parameter (Da), a macroscopic Thiele modulus $F^2$ which is defined as $F^2=k_s a_o L^2/D_m=DaPe_L$ is introduced. The macroscopic Thiele modulus is a core scale equivalent of the pore scale Thiele modulus ($F^2$) and is independent of injection velocity. The dimensionless equations in 2D are given by:

$$(u, v) = \left(-\kappa\frac{\partial p}{\partial x}, -\kappa\frac{\partial p}{\partial y}\right), \tag{17}$$

$$\frac{\partial \varepsilon}{\partial t} + \frac{\partial u}{\partial x} + \frac{\partial v}{\partial y} = 0, \tag{18}$$

$$\frac{\partial(\varepsilon c_f)}{\partial t} + \frac{\partial(uc_f)}{\partial x} + \frac{\partial(vc_f)}{\partial y} = -\frac{DaA_v c_f}{\left(1+\frac{\phi^2 r}{Sh}\right)} + \frac{\partial}{\partial x}\left[\left\{\frac{\alpha_{os}\varepsilon Da}{\Phi^2} + \lambda_X|u|r\eta\right\}\frac{\partial c_f}{\partial x}\right] + \frac{\partial}{\partial y}\left[\left\{\frac{\alpha_{os}\varepsilon Da}{\Phi^2} + \lambda_T|u|r\eta\right\}\frac{\partial c_f}{\partial y}\right], \tag{19}$$

$$\frac{\partial \varepsilon}{\partial t} = \frac{DaN_{ac}A_v c_f}{\left(1+\frac{\phi^2 r}{Sh}\right)}. \tag{20}$$

The boundary and initial conditions used to solve the system of equations are given below:

$$-\kappa\frac{\partial p}{\partial x} = 1 @ x = 0, \tag{21}$$

$$p = 0 @ x = 1, \tag{22}$$

$$-\kappa\frac{\partial p}{\partial y} = 0 @ y = 0 \text{ and } y = \alpha_o, \tag{23}$$

$$c_f = 1 @ x = 0, \tag{24}$$

$$\frac{\partial c_f}{\partial x} = 0 @ x = 1, \tag{25}$$

$$\frac{\partial c_f}{\partial y} = 0 @ y = 0 \text{ and } y = \alpha_o, \tag{26}$$

$$c_f = 0 @ t = 0, \tag{27}$$

$$\varepsilon(x, a, l) = \varepsilon_o + \hat{f} @ t = 0. \tag{28}$$

A constant injection rate boundary condition given by Equation (21) is imposed at the inlet of the domain and the fluid is contained in the domain by imposing zero flux boundary conditions (Equation (23)) on the lateral sides of the domain. The boundary conditions for the transport of acid species are given by Equations (24) through (26). It is assumed that there is no acid present in the domain at time t=0. To simulate wormhole formation numerically, it is necessary to have heterogeneity in the domain which is introduced by assigning different porosity values to different grid cells in the domain according to Equation (28). The porosity values are generated by adding a random number (f) uniformly distributed in the interval [−?$e_o$, ?$e_o$] to the mean value of porosity $e_o$. The quantity a defined as a=?$e_o$/$e_o$ is the magnitude of heterogeneity and the parameter l is the dimensionless length scale of heterogeneity which is scaled using the pore radius, i.e. $l=L_h/(2r_o)=L_h/(?L)$, where $L_h$ is equal to the length scale of the heterogeneity. Unless stated otherwise, $L_h$ is taken as the size of the grid in numerical simulations.

The above system of equations can be reduced to a simple form at very high or very low injection rates to obtain analytical relations for pore volumes required to breakthrough. Face dissolution occurs at very low injection rates where the acid is consumed as soon as it comes in contact with the medium. As a result, the acid has to dissolve the entire medium before it reaches the exit for breakthrough. The stoichiometric pore volume of acid required to dissolve the whole medium is given by the equation:

$$PV_{FaceD} = \frac{\rho_s(1-\varepsilon_o)}{\alpha C_o \varepsilon_o} = \frac{(1-\varepsilon_o)}{N_{ac}\varepsilon_o}, \tag{29}$$

where $C_o$ is the inlet concentration of the acid and $e_o$ is the initial porosity of the medium. At very high injection rates, the residence time of the acid is very small compared to the reaction time and most of the acid escapes the medium without reacting. Because the conversion of the acid is low, the concentration in the medium could be approximated as the inlet concentration. Under these assumptions the model may be reduced to the relationship:

$$\frac{\partial \varepsilon}{\partial t} = \frac{k_s C_o a_v \alpha}{\rho_s\left(1+\frac{\phi^2 r}{Sh}\right)}. \tag{30}$$

Denoting the final porosity required to achieve a fixed increase in the permeability by $e_f$ (this may be calculated from Equation (7)), the above equation may be integrated for the breakthrough time, as follows:

$$t_{bth} = \frac{\rho_s}{k_s C_o \alpha}\int_{\varepsilon_o}^{\varepsilon_f}\frac{\left(1+\frac{\phi^2 r}{Sh}\right)}{a_v}\,d\varepsilon.$$

Thus, the pore volume of acid required for breakthrough at high injection rates is given by:

$$PV_{UniformD} = \frac{t_{bth}u_o}{\varepsilon_o L} = \frac{\rho_s u_o}{k_s C_o \alpha a_o \varepsilon_o L}\int_{\varepsilon_o}^{\varepsilon_f}\frac{\left(1+\frac{\phi^2 r}{Sh}\right)}{A_v}\,d\varepsilon = \frac{1}{DaN_{ac}\varepsilon_o}\int_{\varepsilon_o}^{\varepsilon_f}\frac{\left(1+\frac{\phi^2 r}{Sh}\right)}{A_v}\,d\varepsilon$$

The breakthrough volume increases with increasing velocity.

Figure 3:
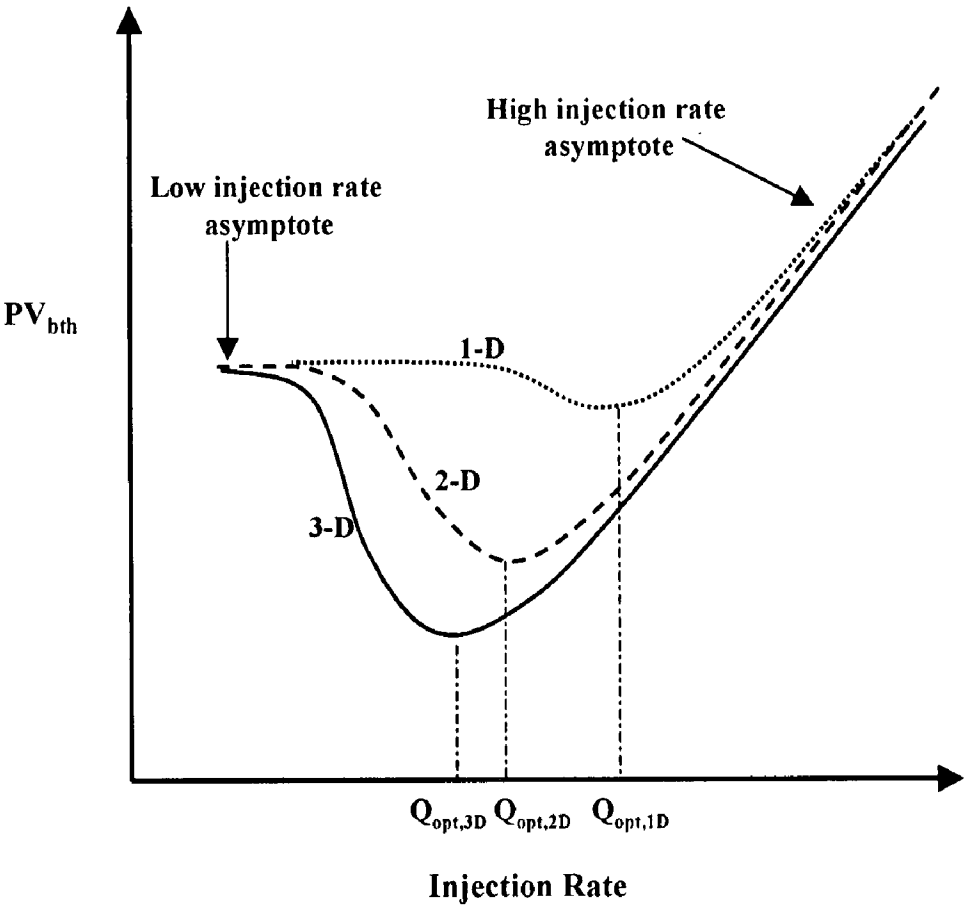
FIG. 3 is a plot showing qualitative trends in breakthrough curves for 1-D, 2-D and 3-D models according to the invention, wherein the optimum injection rate and the minimum pore volume decrease from 1-D to 3-D due to channeling.

To achieve a fixed increase in the permeability, a large volume of acid is required in the uniform dissolution regime where the acid escapes the medium after partial reaction. Similarly, in the face dissolution regime a large volume of acid is required to dissolve the entire medium. In the wormholing regime only a part of the medium is dissolved to increase the permeability by a given factor, thus, decreasing the volume of acid required than that in the face and uniform dissolution regimes. Since spatial gradients do not appear in the asymptotic limits (Equation (29) and Equation (30)) the results obtained from 1-D, 2-D and 3-D models for pore volume of acid required to achieve breakthrough should be independent of the dimension of the model at very low and very high injection rates for a given acid. However, optimum injection rate and minimum volume of acid which arise due to channeling are dependent on the dimension of the model. A schematic showing the pore volume required for breakthrough versus the injection rate is shown in FIG. 3 for 1-D, 2-D and 3-D models.

2D Dissolution Patterns

Numerical simulations may be used to illustrate the effects of heterogeneity, different transport mechanisms and reaction kinetics on dissolution patterns. The model is simulated on a rectangular two-dimensional porous medium of dimensions 2 cm×5 cm ($a_o$=0.4). Acid is injected at a constant rate at the inlet boundary of the domain and it is contained in the domain by imposing a zero-flux boundary condition on the lateral sides of the domain. The simulation is stopped once the acid breaks through the exit boundary of the domain. Here breakthrough is defined as a decrease in the pressure drop by a factor of 100 (or increase in the overall permeability of the medium by 100) from the initial pressure drop.

The numerical scheme useful in some embodiments of the invention is described as follows. The equations are discretized on a 2-D domain using a control volume approach. While discretizing the species balance equation, an upwind scheme is used for the convective terms in the equation. The following algorithm is used to simulate flow and reaction in the medium. The pressure, concentration and porosity profiles in the domain at time t are denoted by $p_t$, $c_t$, and $\epsilon_t$. Porosity and concentration profiles in the domain are obtained for time t+Δt ($c_{t+\Delta t}$, $\epsilon_{t+\Delta t}$), by integrating the species balance and porosity evolution equations simultaneously using the flow field calculated from the pressure profile ($p_t$) by applying Darcy's law. Integration of concentration and porosity profiles is performed using Gear's method for initial value problems. The calculation for concentration and porosity profiles is then repeated for time $t_{half}$=t+Δt/2 using the velocity profile at time t. The flow field at t+Δt/2 is then calculated using the concentration profile $c_{half}$ and porosity profile $\epsilon_{half}$. Using the flow profile at $t_{half}$ the values of concentration and porosity are again calculated for time t+Δt and are denoted by $c_{new}$ and $\epsilon_{new}$. To ensure convergence, the norms $|c_{t+\Delta t}-c_{new}|$ and $|\epsilon_{t+\Delta t}-\epsilon_{new}|$ are maintained below a set tolerance. If the tolerance criterion is not satisfied the calculations are repeated for a smaller time step. The above procedure is repeated until the breakthrough of the acid, which is defined as the decrease in the initial pressure by a factor of 100.

The value of initial porosity in the domain is 0.2. The effect of injection rate on the dissolution patterns is studied by varying the Damköhler number ($D_a$) which is inversely proportional to the velocity. In addition to the dimensionless injection rate ($D_a$), the other important dimensionless parameters in the model are $f^2$, $N_{ac}$, $F^2$, a and l. The effect of these parameters on wormhole formation is investigated.

Magnitude of Heterogeneity

As discussed hereinabove, heterogeneity is an important factor that promotes pattern formation during reactive dissolution Without heterogeneity, the reaction/dissolution fronts would be uniform despite an adverse mobility ratio between the dissolved and undissolved media. In a very porous medium, the presence of natural heterogeneities triggers instability leading to different dissolution patterns. To simulate these patterns numerically, it is necessary to introduce heterogeneity into the model. Heterogeneity could be introduced in the model as a perturbation in concentration at the inlet boundary of the domain or as a perturbation in the initial porosity or permeability field in the domain. In the present model, heterogeneity is introduced into the domain as a random fluctuation of initial porosity values about the mean value of porosity as given by Equation (28). The two important parameters defining heterogeneity are the magnitude of heterogeneity, a, and the dimensionless length scale, l. The effect of these parameters on wormhole formation is investigated hereinafter.

Figure 4:
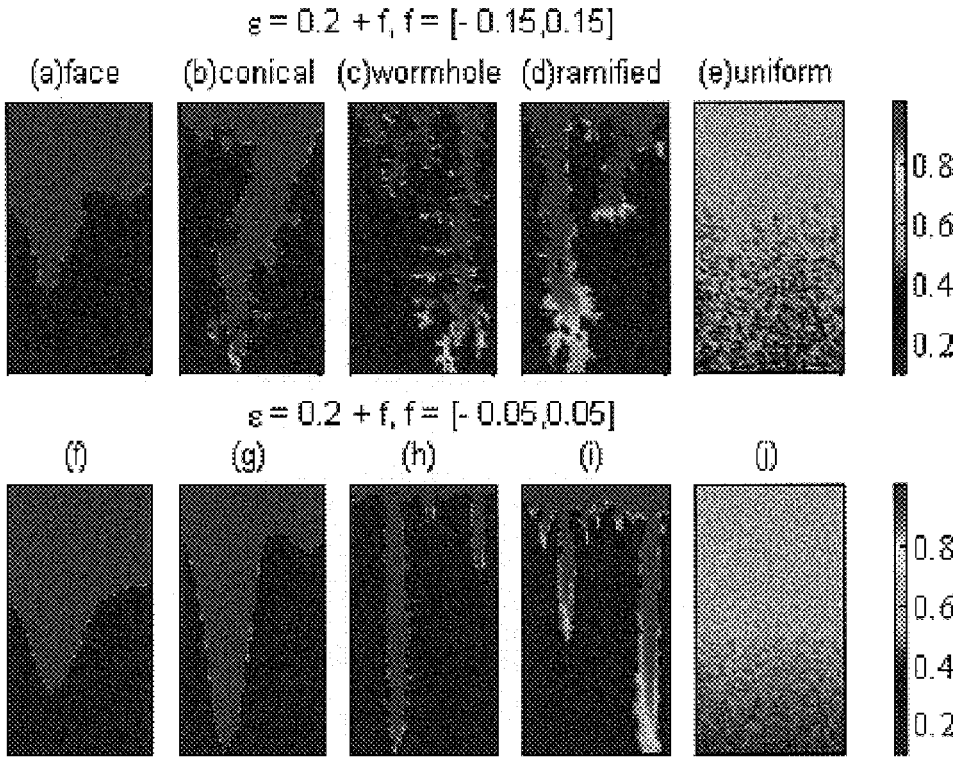
FIG. 4 are illustrations showing porosity profiles at different Damköhler numbers with fluctuations in initial porosity distribution in the interval [−0.15, 0.15].

The influence of the magnitude of heterogeneity (a) is studied by maintaining the length scale of heterogeneity constant (which is the grid size) and varying the magnitude from a small to a large value. FIG. 4, (a) through (e), show the porosity profiles of numerically simulated dissolution patterns at breakthrough for different Damköhler numbers on a domain with a large magnitude of heterogeneity in initial porosity distribution. The fluctuations (f) in porosity (e=0.2+f) are uniformly distributed in the interval [−0.15, 0.15] (a=0.75). FIG. 4, (*f*) through (*j*), show the porosity profiles at breakthrough for the same Damköhler numbers used in FIG. 4, (*a*) through (*e*), but with a small magnitude of heterogeneity in the initial porosity distribution [note that FIGS. 4(*a*) and (*f*) do not show the dissolution front reaching the other end as these pictures were captured just before breakthrough]. The Porosity profiles at different Damköhler numbers with fluctuations in initial porosity distribution in the interval [−0.15, 0.15] are shown in FIG. 4(*a*) through (*e*). FIG. 4(*f*) through (*j*) show porosity profiles for the same Damköhler numbers as used in FIG. 4(*a*) through (*e*) but for fluctuations in the interval [−0.05, 0.05]. The values of Damköhler numbers for different patterns are: (a) Da=3×$10^4$ (?$_o$=30), (b) Da=$10^4$ (?$_o$=10), (c) Da=500 (?$_o$=0.5) (d) Da=40 (?$_o$=0.04), (e) Da=1 (?$_o$=0.01). The values of other parameters fixed in the model are $F^2$=$10^6$, $f^2$=0.07, $N_{ac}$=0.1, $a_o$=0.4.

Figure 5:
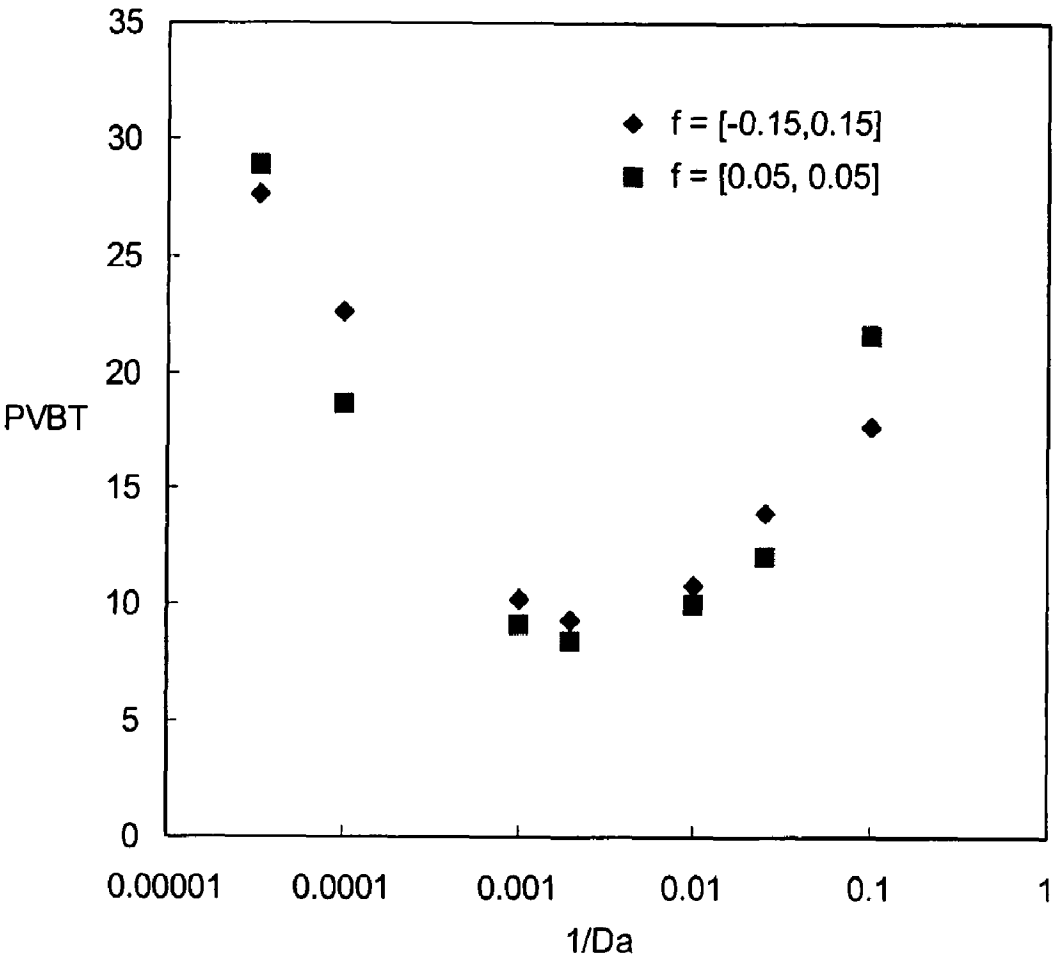
FIG. 5 is a plot showing breakthrough curves for different magnitudes of heterogeneity used in FIG. 4.

The fluctuations (f) in porosity (e=0.2+f) for this case are distributed in the interval [−0.05, 0.05] (a=0.25). It could be observed from the figures that wormholes do not exhibit branching when the magnitude of heterogeneity is decreased. This observation suggests that branching of wormholes observed in carbonate cores could be a result of a wide variation in magnitude of heterogeneities present in the core. FIG. 4 show that at very large Damköhler numbers (low injection rates), the acid reacts soon after it contacts the medium resulting in face dissolution, and at low values of Damköhler number (high injection rates), acid produces a uniform dissolution pattern. Wormholing patterns are created near intermediate/optimum values of the Damköhler number. While changing the magnitude of heterogeneity changes the structure of the wormholes, an important observation to be made here is that the type of dissolution pattern (wormhole, conical etc.) remains the same at a given Damköhler number for different magnitudes of heterogeneity. Thus, heterogeneity is required to trigger the instability and its magnitude determines wormhole structure but the type of dissolution pattern formed is governed by the transport and reaction mechanisms. FIG. 5 shows the pore volume of acid required to breakthrough the core at different injection rates with different levels of heterogeneity for the porosity profiles shown in FIG. 4. The curves show a minimum at intermediate injection rates because of wormhole formation. It could be observed from the breakthrough curves that the minimum pore volume/ breakthrough time and optimum injection rate (Damköhler number) are approximately the same for both levels of heterogeneity.

A second parameter related to heterogeneity that is introduced in the model is the length scale of heterogeneity, l. The effect of this parameter on wormhole structure is dependent on the relative magnitudes of convection, reaction and dispersion levels in the system. The role of this parameter on wormhole formation is thus discussed after investigating the effects of convection, reaction and transverse dispersion in the system.

Convection and Transverse Dispersion

Hereinabove, it was shown that the magnitude of heterogeneity affects wormhole structure but its influence on optimum Damköhler number is not significant. The dissolution pattern produced is observed to depend on the relative magnitudes of convection, reaction and dispersion in the system. Because of the large variation in injection velocities (over three orders of magnitude) in core experiments, different transport mechanisms become important at different injection velocities, each leading to a different dissolution pattern. For example, at high injection velocities convection is more dominant than dispersion and it leads to uniform dissolution, whereas at low injection velocities dispersion is more dominant than convection leading to face dissolution. A balance between convection, reaction and dispersion levels in the system produces wormholes. A qualitative analysis is first presented below to identify some of the important parameters that determine the optimum velocity for wormhole formation and the minimum pore volume of acid. Numerical simulations are performed to show the relevance of these parameters.

Figure 6:
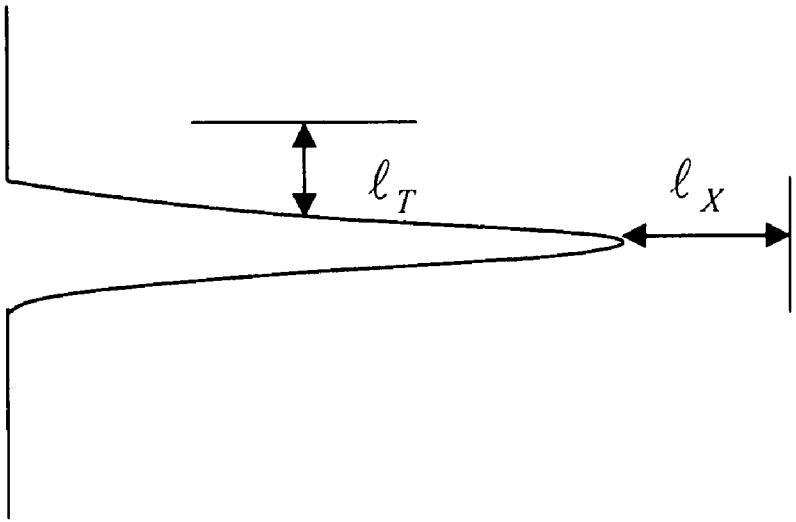
FIG. 6 is a schematic showing the reaction front thickness in the longitudinal and transverse directions to the mean flow.

Consider a channel in a porous medium (see FIG. 6) created because of reactive dissolution of the medium. The injected acid reacts in the medium ahead of the tip and adjacent to the walls of the channel and increases the length as well as the width of the channel. If the growth of the channel in the direction of flow is faster than its growth in the transverse direction then the resulting shape of the channel is thin and is called a wormhole. Alternatively, if the growth is much faster in the transverse direction compared to the flow direction then the channel may be a conical shape. To find the relative growth in each direction, it is necessary to identify the dominant mechanisms by which acid is transported in the direction of flow and transverse to the flow. Because of a relatively large pressure gradient in the flow direction, the main mode of transport in this direction is convection. In the transverse direction, convective velocities are small and the main mode of transport is through dispersion. If the length of the front in the medium ahead of the tip where the acid is consumed is denoted by $l_X$, and the front length in the transverse direction by $l_T$, a qualitative criterion for different dissolution patterns can be given by:

$$\frac{l_T}{l_X} \gg O(1) \Rightarrow \text{Face dissolution} \tag{31}$$

$$\frac{l_T}{l_X} \sim O(1) \Rightarrow \text{Wormhole, and} \tag{32}$$

$$\frac{l_T}{l_X} \ll O(1) \Rightarrow \text{Uniform dissolution} \tag{33}$$

An approximate magnitude of $l_X$ can be obtained from the convection-reaction equation:

$$u_{tip}\frac{\partial C_f}{\partial x'} = -k_{eff}C_f \tag{34}$$

where $u_{tip}$ is the velocity of the fluid at the tip of the wormhole and $k_{eff}$ is an effective rate constant defined as:

$$\frac{1}{k_{eff}} = \left(\frac{1}{k_s a_v} + \frac{1}{k_c a_v}\right).$$

Thus, the length scale over which the acid is consumed in the flow direction is given by:

$$l_X \sim \frac{u_{tip}}{k_{eff}}. \tag{35}$$

In a similar fashion, the length scale $l_T$ in the transverse direction is given by the dispersion-reaction equation:

$$D_{eT}\frac{\partial^2 C_f}{\partial y'^2} = k_{eff}C_f.$$

where $D_{eT}$ is the transverse dispersion coefficient. The length scale $l_T$ in the transverse direction is given by:

$$l_T \sim \sqrt{\frac{D_{eT}}{k_{eff}}}.$$

The ratio of transverse to axial length scales is given by:

$$\frac{l_T}{l_x} \sim \frac{\sqrt{k_{eff}D_{eT}}}{u_{tip}} = \Lambda. \tag{37}$$

The qualitative criteria for different channel shapes in Equations (31) through (33) in terms of parameter ? are given by ?>>O(1) for face dissolution, ?~0.1 to 1 for wormhole formation and ?<<O(1) for uniform dissolution. The parameter $$\Lambda = \frac{\sqrt{\left(\frac{k_c k_s}{k_s + k_c}\right)a_v D_{eT}}}{u_{tip}} \tag{38}$$

used for determining the conditions for wormhole formation includes the effect of transverse dispersion through $D_{eT}$, reaction rate constant $k_s$, pore-scale mass transfer coefficient $k_c$, structure property relations through $a_v$, effect of convection through velocity $u_{tip}$, and is independent of domain length L. It should be noted that the above quantities change with time and thus ? provides only an approximate measure for wormhole formation but it is an important parameter to study wormholing. For the case of mass transfer controlled reactions, the parameter reduces to $\Lambda=\sqrt{k_c a_v D_{eT}}/u_{tip}$ while for kinetically controlled reactions it reduces to $\Lambda=\sqrt{k_s a_v D_{eT}}/u_{tip}$. The optimum injection velocity $$u_{opt} \sim \sqrt{\left(\frac{k_c k_s}{k_s + k_c}\right) a_v D_{eT}} = \sqrt{k_{eff} D_{eT}}$$

scales as square root of effective rate constant and transverse dispersion coefficient. The parameter ? in Equation (38) can be written in terms of dimensionless parameters Damköhler number $D_a$ and Peclet number $Pe_L$ as:

$$\Lambda = \sqrt{\frac{Da}{Pe_L\left(1 + \frac{\phi^2 r}{Sh}\right)}}\,(A_v D_T)^{1/2} M \tag{39}$$

$$= \Lambda_o (A_v D_T)^{1/2} M \tag{40}$$

where $M = u_o / u_{tip}$.

For clarity, kinetically controlled reactions ($f^2r/Sh<<1$) are analyzed first. The analysis of mass transfer controlled reactions ($f^2r/Sh>>1$) is presented hereinbelow. For kinetically controlled reactions, $?_o$ can be reduced to $$\Lambda_o = \sqrt{\frac{Da}{Pe_L}} = \frac{Da}{\Phi} = \sqrt{\frac{k_s a_o D_m}{u_o^2}}\,. \tag{41}$$

It is observed in the numerical simulations that $?_o$~0.1 to 1 gives a good first approximation to wormhole formation criterion in Equation (39). FIG. 4 shows the values of $?_o$ for different dissolution patterns in the kinetic regime. Patterns which may be described by models of the invention include wormhole patterns, face patterns, conical patterns, ramified patterns, uniform patterns, and the like. From FIG. 4, it is shown that wormholing patterns may occur at $?_o$=0.5 as indicated by the scaling. For small values of $?_o$ (for example $?_o$=0.001 or less), uniform dissolution may be observed/computed. For large values of $?_o$ (for example $?_o$=5 or more, such as $?_o$=30), face dissolution may be observed/computed. In the range of about $0.1<?_o<5$ rate of formation of wormholes may be observed/computed. The value of the parameter $?_o$ gives an estimate of the optimum injection velocity. The minimum pore volume required for breakthrough, however, depends on the diameter of the wormhole because the volume of acid required to dissolve the material in the wormhole decreases as the wormhole diameter decreases. Since the diameter of the wormhole depends on the thickness of the front $l_T$ in the transverse direction, it is necessary to identify the parameter that controls the transverse front thickness. The parameter that determines the front thickness can be obtained from Equation (36), $$\frac{l_T}{L} \sim \sqrt{\frac{D_{eT}}{k_{eff} L^2}} = \frac{\sqrt{\left(1 + \frac{\phi^2 r}{Sh}\right)}}{\Phi}\left(\frac{D_T}{A_v}\right)^{1/2}. \tag{42}$$

Again, for kinetically controlled reactions, the above equation reduces to $$\frac{l_T}{L} \sim \frac{1}{\Phi}\left(\frac{D_T}{A_v}\right)^{1/2}. \tag{43}$$

Figure 7:
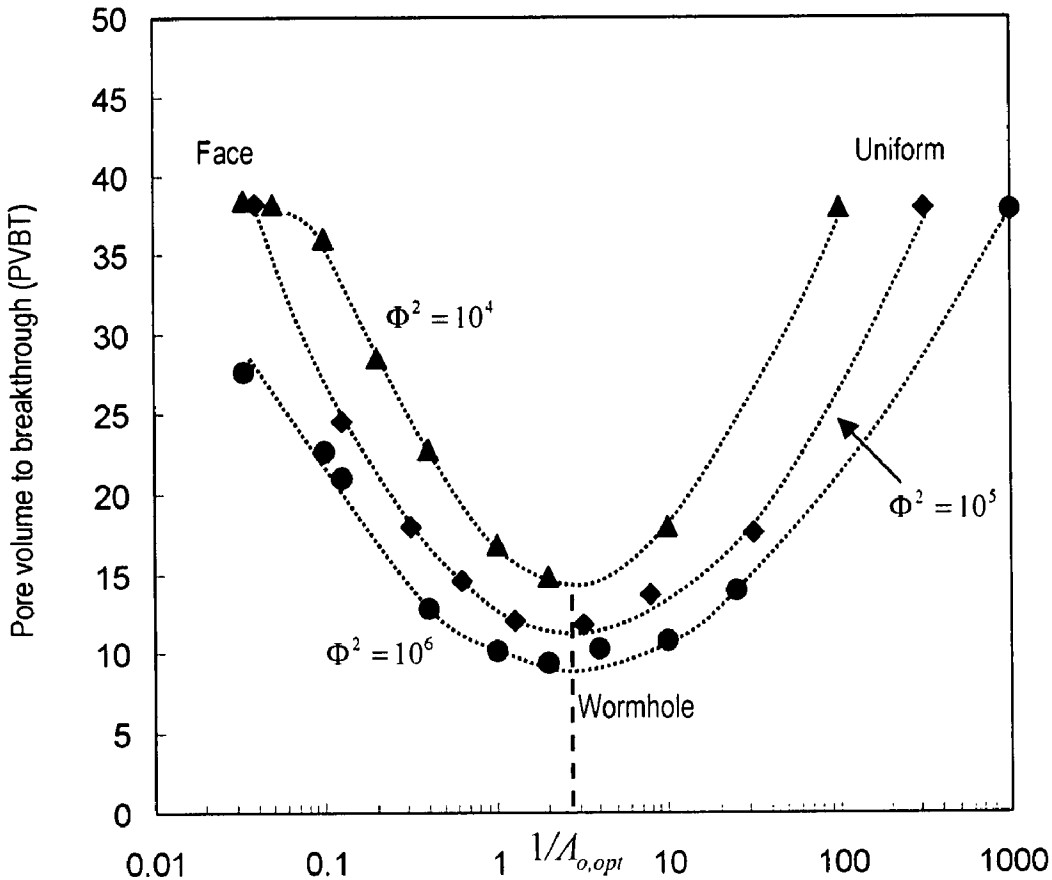
FIG. 7 is a plot showing the pore volume of acid required to breakthrough versus the parameter $?_o^{-1}$ for different values of macroscopic Thiele modulus $F^2$.
Figure 8:
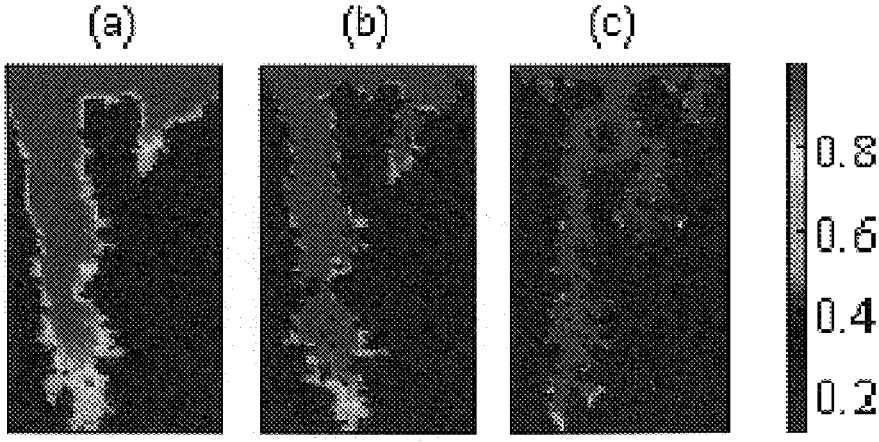
FIG. 8 shows porosity profiles at the optimum injection rate for the breakthrough curves shown in FIG. 7 for different values of $F^2$.

From Equation (43) it can be seen that the front thickness or the wormhole diameter is inversely proportional to the square root of macroscopic Thiele modulus $F^2$. Thus, for increasing values of macroscopic Thiele modulus (or decreasing levels of dispersion), the diameter of the wormhole decreases, thereby decreasing the minimum pore volume required to breakthrough. FIG. 7 shows pore volume of acid required for breakthrough versus reciprocal of the parameter $?_o$ for three different values of $F^2$ for a kinetically controlled reaction ($f^2$=0.07). The minimum pore volume required to breakthrough decreases with increasing values of macroscopic Thiele modulus $F^2$. FIG. 8 shows the final porosity profiles at the optimum injection rate in FIG. 7 for different values of macroscopic Thiele modulus, (a) $F^2=10^4$, (b) $F^2=10^5$, and (c) $F^2=10^6$. It can be seen from FIG. 8 that the wormhole diameter decreases with increasing values of $F^2$. The above analysis shows that optimum injection rate and minimum pore volume required for breakthrough are determined by $?_o$ and macroscopic Thiele modulus $F^2$.

Figure 9:
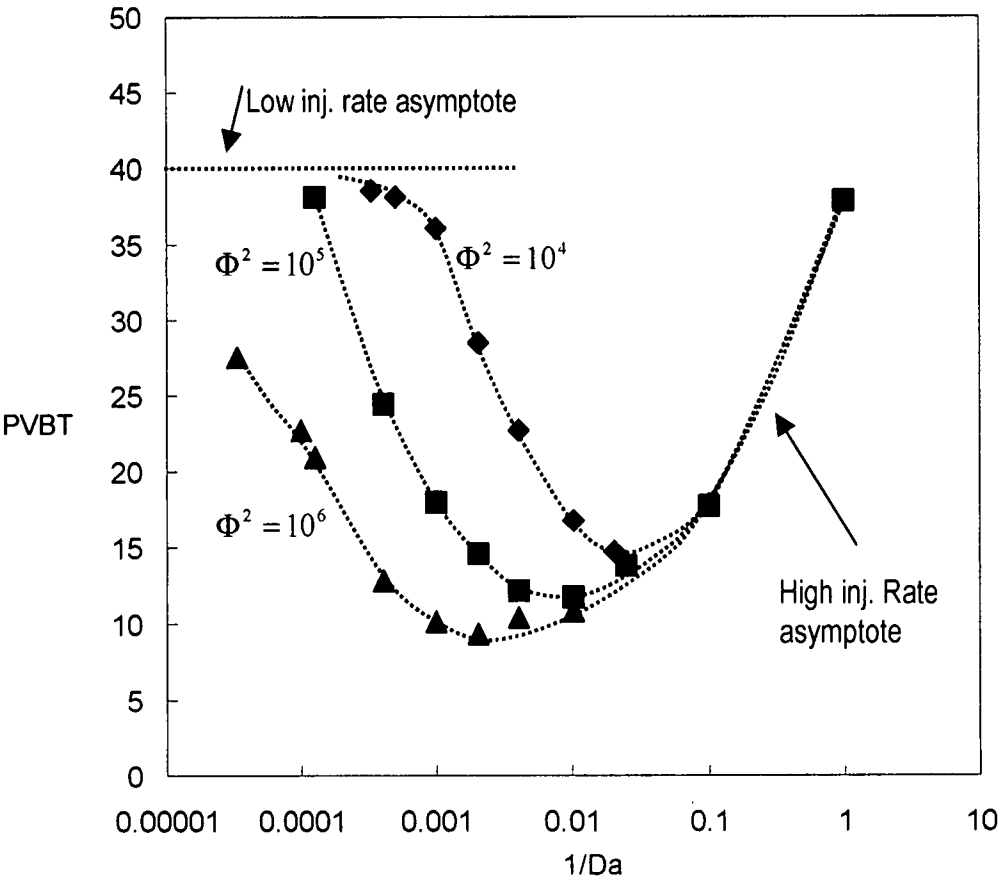
FIG. 9 is a plot showing breakthrough curves in FIG. 7 plotted as function of the reciprocal of Damköhler number.

The breakthrough curves in FIG. 7 are plotted again with respect to Damköhler number Da in FIG. 9 for different values of macroscopic Thiele modulus $F^2$. It can be seen from the figure that the optimum Damköhler number is dependent on the value of $F^2$. Thus, changing the value of $F^2$ changes the optimum Damköhler number whereas the parameter ? is always of order unity for different values of $F^2$ (see FIG. 7). ? may be better criterion than the optimum Damköhler number for predicting wormhole formation. As shown in FIG. 9, $F^2$ does not affect the number of pore volumes required to breakthrough in the high injection rate regime. This is because dispersion effects may be negligible at high injection rates, where convection and reaction are the dominant mechanisms. The slope of the breakthrough curve at low injection rates and the minimum pore volume are dependent on the value of $F^2$ showing that dispersion becomes an important mechanism at lower injection rates where wormholing, conical and face dissolution occur. The breakthrough curve for $F^2=10^4$ shows a minimum pore volume that is higher than that required for larger values of $F^2$ and it also reaches the low injection rate asymptote at injection rates higher than that required for larger values of $F^2$. This is due to high dispersion level in the system for $F^2=10^4$, because acid is spread over a larger region at low injection rates, thus, reacting with more material and consuming more acid. Eventually, all the breakthrough curves for different values of $F^2$ will reach the low injection rate asymptote but the value of injection rate at which they reach the asymptote will depend on the value of $F^2$ or the level of dispersion in the system It is observed in the simulations that the effect of axial dispersion on the dissolution patterns is negligible when compared to transverse dispersion. This was verified by suppressing axial and transverse dispersion terms alternatively and comparing it with simulations performed by retaining both axial and transverse dispersion in the model. Transverse dispersion is a growth arresting mechanism in wormhole propagation because it transfers the acid away from the wormhole and therefore prevents fresh acid from reaching the tip of the wormhole.

FIG. 9 shows that convection and reaction are dominant mechanisms at high injection rates leading to uniform dissolution, and at very low injection rates, transverse dispersion and reaction are the dominant mechanisms leading to face dissolution.

Reaction Regime

The magnitude of $f^2r/Sh$ or $k_s/k_c$ in the denominator of the local equation $$C_s = \frac{C_f}{\left(1 + \frac{k_s}{k_c}\right)} = \frac{C_f}{\left(1 + \frac{\phi^2 r}{Sh}\right)}$$

determines whether a reaction is in the kinetic or mass transfer controlled regime. In practice, a reaction is considered to be in the kinetic regime if $f^2r/Sh<0.1$ and in the mass transfer controlled regime if $f^2r/Sh>10$. For values of $f^2r/Sh$ between 0.1 and 10, a reaction is considered to be in the intermediate regime. The Thiele modulus $f^2$ is defined with respect to the initial conditions, but the dimensionless pore radius r and Sh change with position and time making the term $f^2r/Sh$ a function of both position and time. At any given time, it may be difficult to ascertain whether the reaction in the entire medium is mass transfer or kinetically controlled because these regimes of reaction are defined for a local scale, and may not hold true for the entire system. In Table 2, the values of Thiele modulus, the initial values of $f^2r/Sh$ (r=1) and the ratio of interface concentration $C_s$ to fluid phase concentration $C_f$ for different acids used are tabulated for initial pore radii in the range of 1 μm-20 μm. A typical value of 3 is assumed for Sherwood number in the calculations. The ratios of $C_s/C_f$ in the table show that all the acids except HCl are in the kinetic regime during the initial stages of dissolution. The reaction between HCl and calcite is in the intermediate regime. As the reaction proceeds, the pore size increases, thereby increasing the value of $f^2r/Sh$, leading to transitions between different regimes of reaction. To describe these transitions and to capture both the reaction regimes simultaneously, two concentration variables are utilized in the model. As a first approximation, it is assumed that the mass transfer coefficient to be the same in the axial and transverse directions.

TABLE 2

Ratio of interface to cup-mixing concentration for different acids.

| Acid | $D_m$ [cm²/s] | $k_s$ [cm/s] | $f^2$ [$r_o$ = 1 μm-20 μm] | $f^2/Sh$ | $C_s/C_f$ |
|---|---|---|---|---|---|
| 0.25-M EDTA pH = 13 | $6 \times 10^{-6}$ | $5.3 \times 10^{-5}$ | 0.0017-0.034 | 0.0006-0.0113 | 0.99-0.98 |
| 0.25-M DTPA pH = 4.3 | $4 \times 10^{-6}$ | $4.8 \times 10^{-5}$ | 0.0024-0.048 | 0.0008-0.016 | 0.99-0.98 |
| 0.25-M EDTA pH = 4 | $6 \times 10^{-6}$ | $1.4 \times 10^{-4}$ | 0.0046-0.092 | 0.0015-0.0306 | 0.99-0.97 |
| 0.25-M CDTA pH = 4.4 | $4.5 \times 10^{-6}$ | $2.3 \times 10^{-4}$ | 0.01-0.2 | 0.003-0.06 | 0.99-0.94 |
| 0.5-M HCl | $3.6 \times 10^{-5}$ | $2 \times 10^{-1}$ | 1.11-22.2 | 0.37-7.4 | 0.73-0.135 |

Above, it has been shown that $\Lambda_o=\sqrt{Da/Pe_l}\sim O(1)$ gives an approximate estimate of the optimal injection conditions for kinetically controlled reactions, and the diameter of the wormhole or the pore volume of acid required to breakthrough was observed to depend on the macroscopic Thiele modulus $F^2$. The extensions of these parameters to mass transfer controlled reactions are discussed here. For the case of a mass transfer controlled reaction $f^2r/Sh>>1$), the species balance Equation (19) can be reduced to $$\frac{\partial(\varepsilon c_f)}{\partial t} + \frac{\partial(uc_f)}{\partial x} + \frac{\partial(vc_f)}{\partial y} = -\frac{P_T Sh A_v}{r} c_f + \frac{\partial}{\partial x}\left[\left\{\frac{\alpha_{os}\varepsilon P_T}{\Phi_m^2} + \lambda_x|u|r\eta\right\}\frac{\partial c_f}{\partial x}\right] + \frac{\partial}{\partial y}\left[\left\{\frac{\alpha_{os}\varepsilon P_T}{\Phi_m^2} + \lambda_y|u|r\eta\right\}\frac{\partial c_f}{\partial y}\right] \tag{44}$$

where $$P_T = \frac{a_o L D_m}{2u_o r_o}$$

is an equivalent to the Damköhler number for mass transfer controlled reactions defined as the ratio of convection time to diffusion time and $$\Phi_m^2 = P_T Pe_L = \frac{a_o L^2}{2r_o} \tag{45}$$

is an equivalent to the macroscopic Thiele modulus $F^2$. Note that molecular diffusion or mass transfer coefficients do not appear in the above definition because the Peclet number is defined based on molecular diffusion assuming that the main contribution to dispersion is from molecular diffusion. The parameter that determines the optimal injection rate can be derived from Equation (39) and is given by $$\Lambda = \sqrt{\frac{P_T}{Pe_L}}\left(\frac{ShA_v D_T}{r}\right)^{1/2} \tag{46}$$

$$M = \Lambda_{om}\left(\frac{ShA_v D_T}{r}\right)^{1/2} M$$

where

-continued $$\Lambda_{om} = \sqrt{P_T / Pe_L} = \sqrt{\frac{a_o D_m^2}{2u_o^2 r_o}}. \tag{47}$$

From Equation (42), it can be shown that the minimum pore volume depends on the parameter $F_m$. Equation (46) shows that structure property relations have a stronger influence on the optimal criterion for mass transfer controlled reactions when compared to kinetically controlled reactions where $$\Lambda = \sqrt{\frac{Da}{Pe_L}}\,(A_v D_T)^{1/2} M.$$

Figure 10:
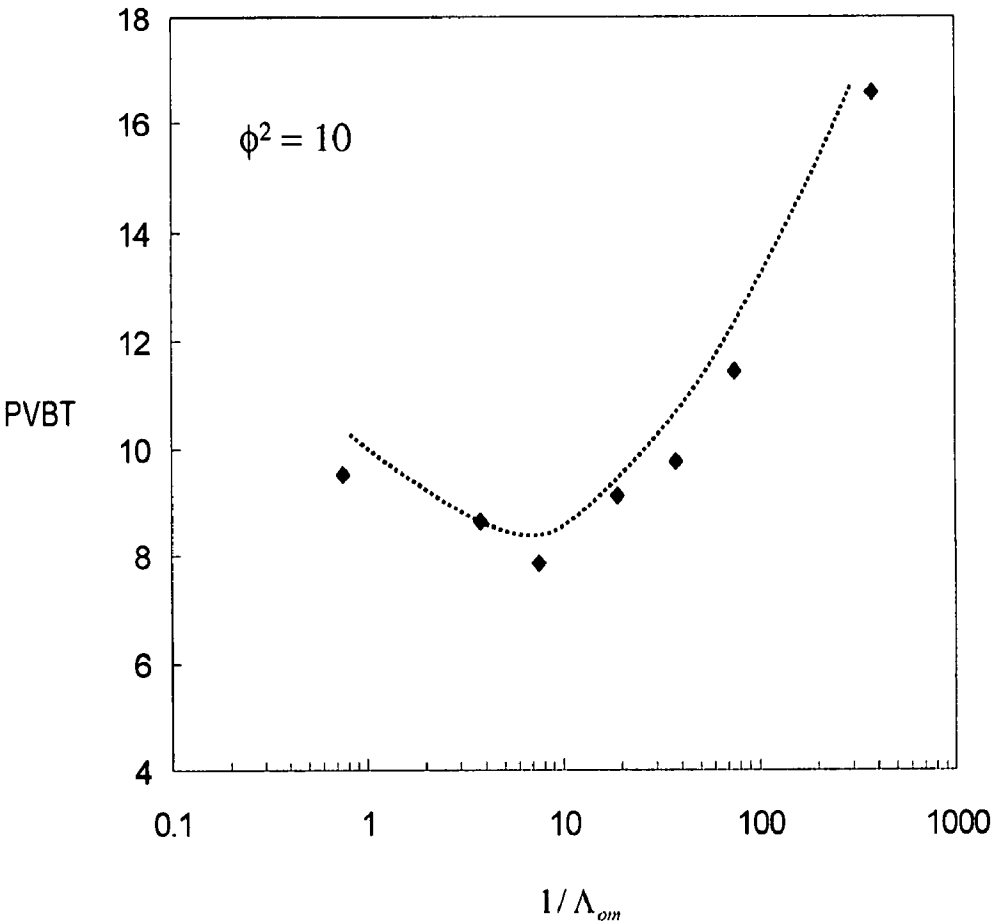
FIG. 10 is a plot showing the breakthrough curve of a mass transfer controlled reaction ($F^2$=10).

This result is expected because the mass transfer coefficient is a function of the structure of the porous medium. FIG. 10 shows the pore volume of acid required to breakthrough for a mass transfer controlled reaction ($f^2$=10) as a function of the reciprocal of $?_{om}$. The breakthrough curve shows a minimum at $?_{om}$=0.13. The values of other parameters are $N_{ac}$=0.1, $e_o$=0.2, f∈[−0.15, 0.15], $F_m$=3779. However, because of a strong dependence on the structure property relations for mass transfer controlled reactions, the value of $?_{om}$ for wormhole formation is expected to be a function of the structure-property relations. The effect of structure-property relations on $?_{om}$ is investigated in the following subsection.

Figure 11:
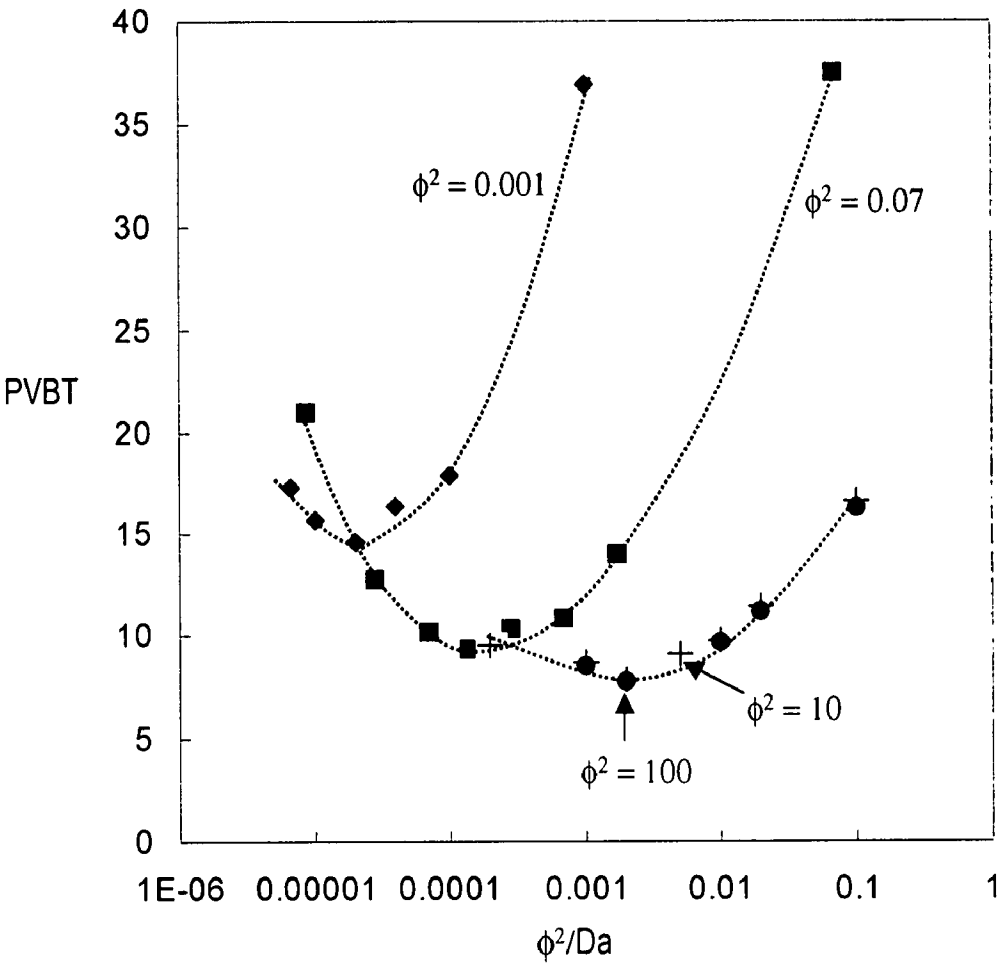
FIG. 11 is a plot showing the influence of the reaction rate constant or $F^2$ on the breakthrough curves.

FIG. 11 shows a comparison of breakthrough curves for kinetic and mass transfer controlled reactions as a function of dimensionless injection rate $f^2$/Da. In the FIG. 11 plot, the reaction rate constant or $f^2$ is varied to simulate breakthrough curves of kinetic ($f^2$=0.001, 0.07) and mass transfer ($f^2$=10, 100) controlled reactions. The x-coordinate is independent of reaction rate (parameters: $N_{ac}$=0.1, $e_o$=0.2, f∈[−0.15, 0.15]). Note that this example of dimensionless injection rate is independent of the reaction rate constant. In the breakthrough curves shown in FIG. 11, the effect of reaction regime on breakthrough curves is investigated by changing the reaction rate or pore scale Thiele modulus from a very low ($f^2$=0.001) to a very large value ($f^2$=100), thereby changing the reaction regime from kinetic to mass transfer control. It could be observed that the optimum injection rate increases with increasing Thiele modulus. Thus, acids like HCl which have a Thiele modulus larger than EDTA should be injected at a higher rate to create wormholes. The minimum volume required to break through the core is observed to be higher for lower values of Thiele modulus. This observation is consistent with experimental data in Table 2 above, where the minimum volume required for EDTA is higher than the minimum volume required for HCl to break through the core. It can also be observed from FIG. 11 that the injection rate is independent of reaction rate constant for large values of $f^2$ (see breakthrough curves of $f^2$=10 and 100) because the system is mass transfer controlled. FIG. 11 demonstrates the effect of competition between mass transport and reaction at the pore scale on optimal conditions for injection. Because increasing temperature increases the rate constant, a similar behavior as observed in FIG. 11 for increasing rate constants can be expected when the temperature is increased.

Here, the role of heterogeneity length scale ($l=L_h/2r_o$) on wormhole formation is considered. In all the simulations presented in this work, $L_h$ is taken to be the grid size (which in physical units is about 1 mm). In practice, this length scale in carbonates can vary from the pore size to the core size. It may be seen that when $L_h \ll l_T$ and $l_X$, the structure of the wormholes is not influenced by $L_h$, as transverse dispersion dominates over the small length scales. Similarly, when $L_h \gg l_T$ and $l_X$, wormhole formation is not influenced by $L_h$, as it is a local phenomenon now dictated by dispersion and reaction at smaller scales. Thus, the heterogeneity length scale may play a role in determining the wormhole structure when $L_h$ is of the same order of magnitude as the dispersion-reaction ($l_T$) and convection-reaction ($l_X$) length scales. This effect can be determined quantitatively by considering finer grids for the solution.

Acid Capacity Number

Figure 12:
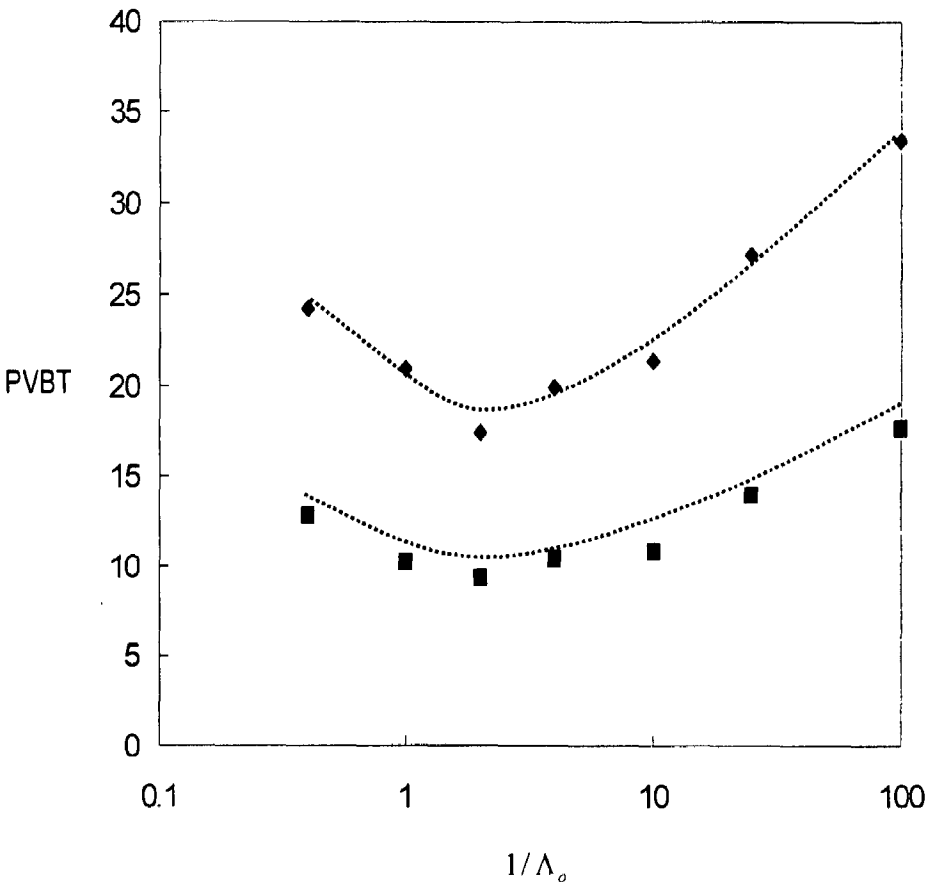
FIG. 12 is a plot showing pore volume required for breakthrough is inversely proportional to the acid capacity number (parameters: $F^2$=0.07, $\epsilon_o$=0.2, f?[−0.15, 0.15], F=103).

The acid capacity number $N_{ac}$(=$aC_o/?_s$) depends on the inlet concentration of the acid. FIG. 12 shows the breakthrough curves for acid capacity numbers of 0.05 and 0.1. From the breakthrough curves it can be seen that the minimum shifts proportionally with the acid capacity number. For low values of acid capacity number ($N_{ac} \ll 1$), the time scale over which porosity changes significantly is much larger than the time scale associated with changes in concentration. In such a situation, a pseudo-steady state approximation can be made and Equations (19) and (20) can be reduced to $$u\frac{\partial c_f}{\partial x} + v\frac{\partial c_f}{\partial y} = -\frac{DaA_v c_f}{\left(1+\frac{\phi^2 r}{Sh}\right)} + \frac{\partial}{\partial x}\left[\left\{\frac{\alpha_{os}\varepsilon Da}{\Phi^2} + \lambda_x|u|r\eta\right\}\frac{\partial c_f}{\partial x}\right] + \frac{\partial}{\partial y}\left[\left\{\frac{\alpha_{os}\varepsilon Da}{\Phi^2} + \lambda_y|u|r\eta\right\}\frac{\partial c_f}{\partial y}\right] \tag{48}$$

and $$\frac{\partial \varepsilon}{\partial \tau} = \frac{DaA_v c_f}{\left(1+\frac{\phi^2 r}{Sh}\right)}, \tag{49}$$

where $t=N_{ac}t$. Since the above equations are independent of $N_{ac}$, the breakthrough time $t_{BT}$ is independent of $N_{ac}$. The breakthrough volume, defined as $t/e_o=t_{BT}/N_{ac}e_o$, is therefore inversely proportional to acid capacity number at low values of $N_{ac}$ as demonstrated in FIG. 12 (parameters: $f^2$=0.07, $e_o$=0.2, f∈[−0.15, 0.15], F=103).

Effect of Structure-Property Relations

In the previous subsections, the effect of heterogeneity, injection conditions, reaction regime and acid concentration on wormhole formation were investigated using the structure-property relations given by Equations (7) through (9). It has been observed that the optimum injection rate and breakthrough volume are governed by parameters $?_o$ and $F^2$ for kinetic reactions and $?_{om}$ and $F^2{}_m$ for mass transfer controlled reactions for a given set of structure-property relations. In this section, the effect of structure-property relations on the optimal conditions is investigated using a different correlation given by $$\frac{K}{K_o} = \left(\frac{\varepsilon}{\varepsilon_o}\right)^3 \exp\left[b\left(\frac{\varepsilon-\varepsilon_o}{1-\varepsilon}\right)\right]. \tag{50}$$

Figure 13:
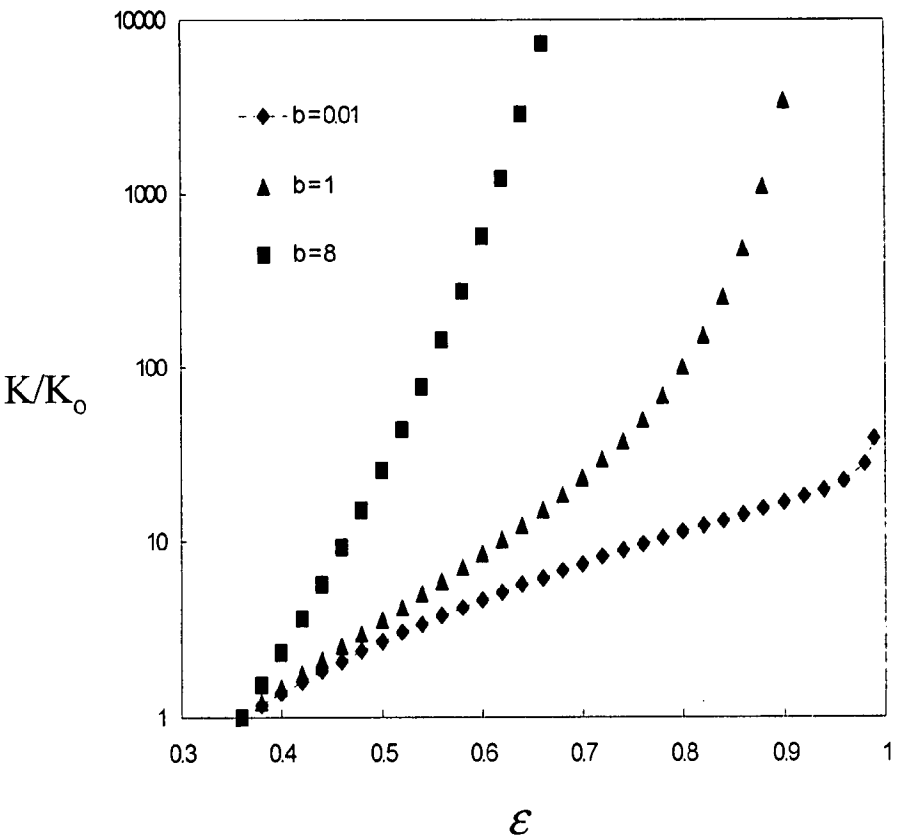
FIG. 13 shows the evolution of permeability with porosity for different values of b.
Figure 14:
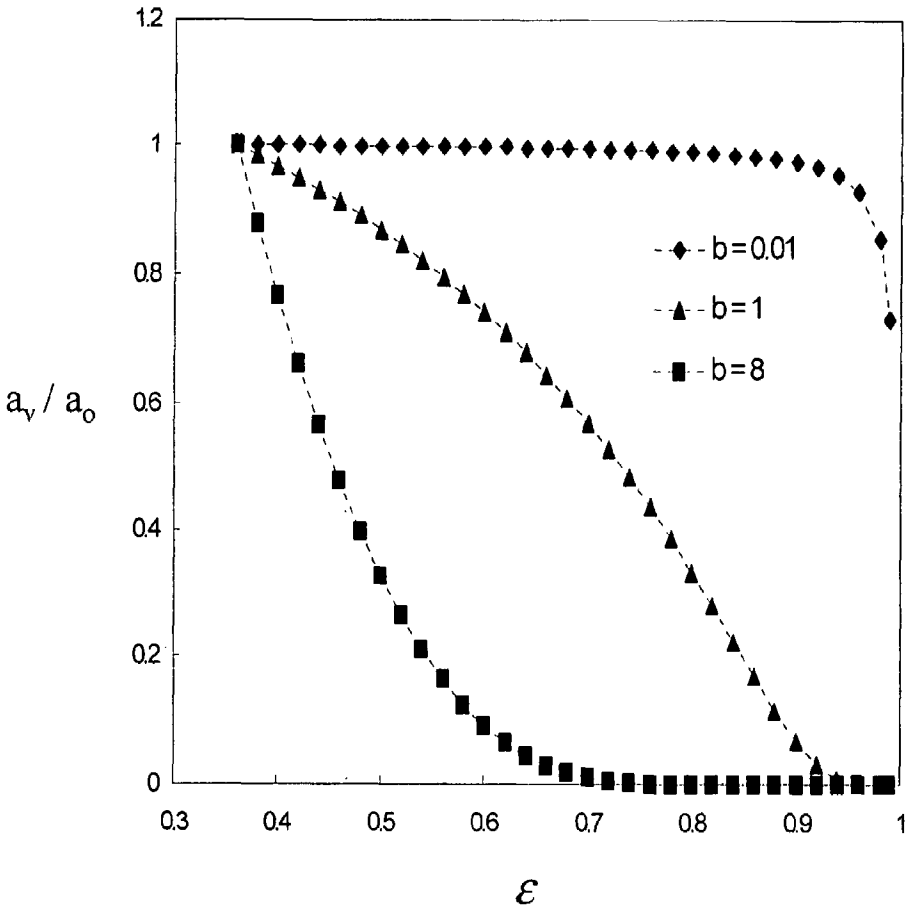
FIG. 14 is a plot showing the change in interfacial area is very gradual for low values of b and steep for large values of b.

The relations for average pore radius and interfacial area are given by Equations (8) and (9). By changing the value of b in Equation (50), the increase in local permeability with porosity can be made gradual or steep. FIGS. 13 and 14 show the effect of b on evolution of permeability and interfacial area with porosity. FIG. 13 shows the evolution of permeability with porosity for different values of b, and the initial value of porosity $e_o$ is equal to 0.36. FIG. 14 illustrates change in interfacial area is very gradual for low values of b and steep for large values of b. It can be seen from FIGS. 13 and 14 that for low values of b, the changes in permeability and interfacial area with porosity are gradual until the value of local porosity is close to unity and the change is very steep for large values of b.

Figure 15:
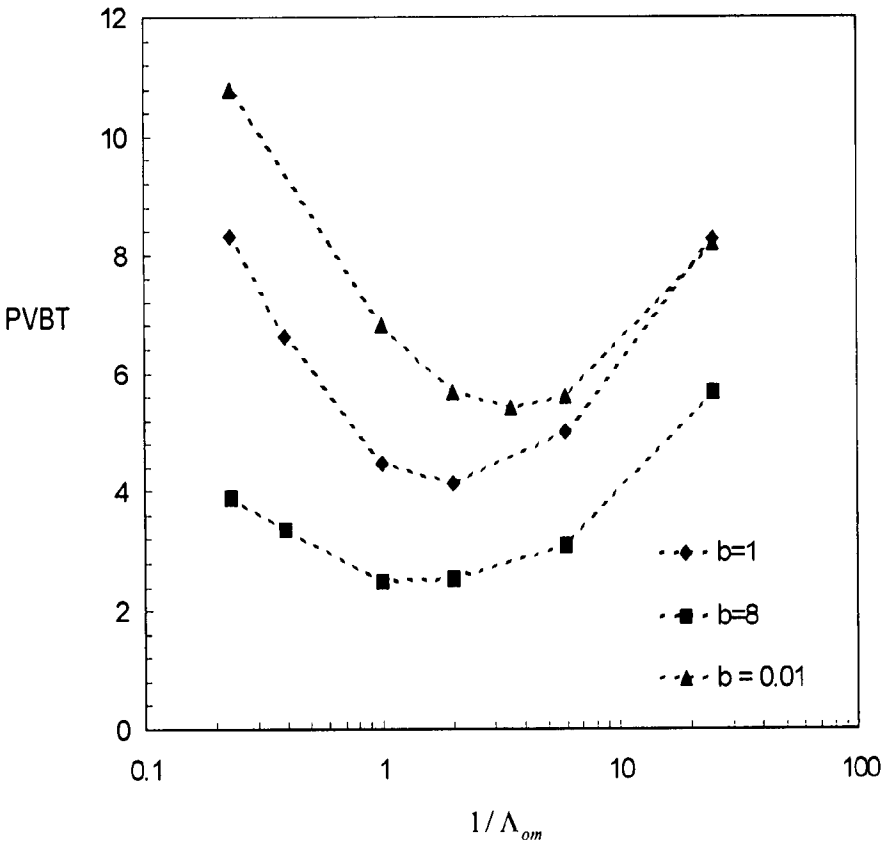
FIG. 15 is a plot showing the effect of structure-property relations on breakthrough volume is shown in the figure by varying the value of b.

FIG. 15 shows the effect of structure property relations on the breakthrough curve for very low and large values of b. The effect of structure-property relations on breakthrough volume is shown in the figure by varying the value of b. For low values of b the evolution of permeability and interfacial area are gradual and the evolution is steep for large values of b. The parameters used in the simulation are $e_o$=0.36, f∈[−0.03, 0.03], $f^2$=50, $F_m$=534, $a_o$=0.2. A mass transfer controlled reaction is considered in these simulations because the effect of structure property relations on optimal conditions is significant for mass transfer controlled reactions as discussed earlier. It can be seen that the optimum $?_{om}$, although different for different structure property relations is approximately order unity for large changes in the qualitative behavior of structure-property relations. The value of minimum pore volume to breakthrough is also observed to depend on the structure-property relations. The lower value of minimum pore volume for a large value of b or a steep change in evolution of permeability is because of a rapid increase in adverse mobility ratio between the dissolved and undissolved medium at the reaction front. This may lead to faster development and propagation of wormholes resulting in shorter breakthrough times or lower pore volumes to breakthrough.

Experimental Comparison

Figure 16:
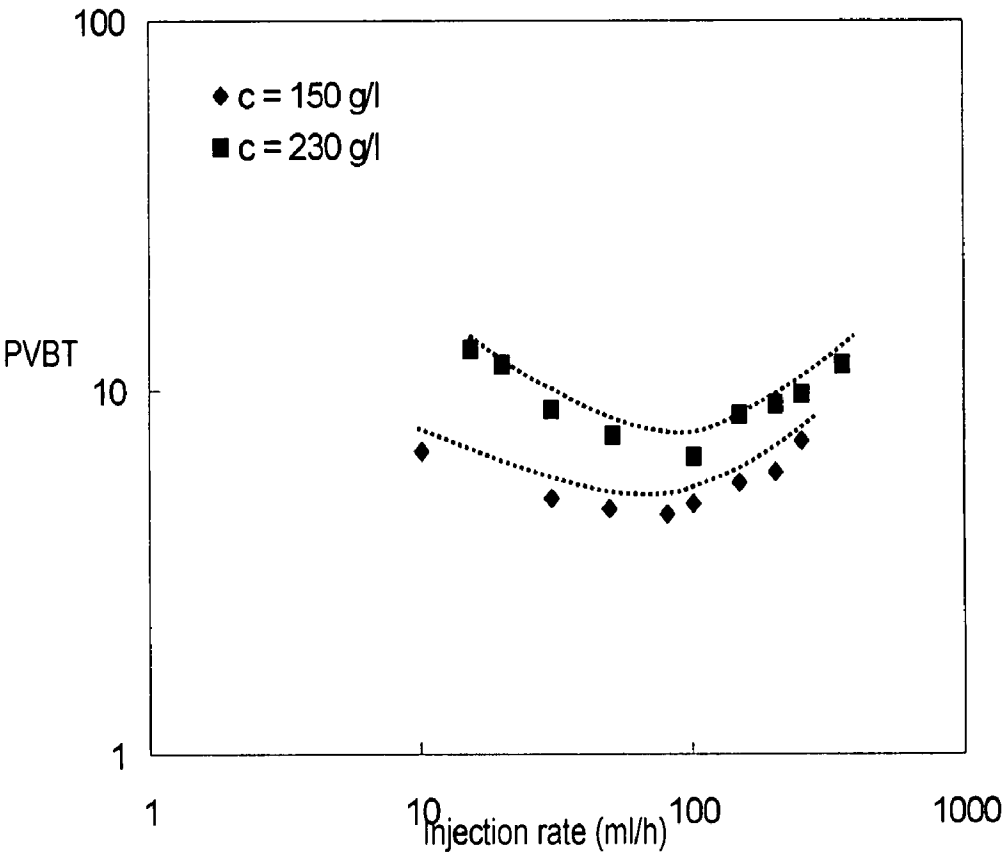
FIG. 16 shows the experimental data on salt dissolution reported Golfier, F., Bazin, B., Zarcone, C., Lenormand, R., Lasseux, D. and Quintard, M.: "*On the ability of a Darcy-scale to capture wormhole formation during the dissolution of a porous medium*," J. Fluid Mech., 457, 213-254 (2002).

The models disclosed herein are 2-D (two dimensional), and are compared to 2-D experiments on saltpacks reported in Golfier, F., Bazin, B., Zarcone, C., Lenormand, R., Lasseux, D. and Quintard, M.: "*On the ability of a Darcy-scale model to capture wormhole formation during the dissolution of a porous medium*," J. Fluid Mech., 457, 213-254 (2002). In these experiments, an under-saturated salt solution was injected into solid salt packed in a Hele-Shaw cell of dimensions 25 cm in length, 5 cm in width, and 1 mm in height. Because the height of the cell is very small compared to the width and the length of the cell, the configuration is considered two-dimensional. The average values of permeability and porosity of the salt-packs used in the experiments are reported to be $1.5\times10^{-11}$ $m^2$ and 0.36 respectively. Solid salt dissolves in the under-saturated salt solution and creates dissolution patterns that are very similar to patterns observed in carbonates. The dissolution of salt is assumed to be a mass transfer controlled process. FIG. 16 shows the experimental data on pore volumes of salt solution required to breakthrough at different injection rates for two different inlet concentrations (150 g/l and 230 g/l) of salt solution. The saturation concentration ($C_{sat}$) of salt is 360 g/l and the density of salt ($?_{salt}$) is 2.16 g/$cm^3$. The dissolution of salt in an under-saturated salt solution is a process very similar to dissolution of carbonate due to reaction with acid and the model developed here can be used for salt dissolution by defining the acid concentration to be $C_f=C_{sat}-C_{salt}$. Thus, the acid capacity number for a salt solution of concentration $C_o$ g/l is given by $$N_{ac} = \frac{C_{sat} - C_o}{\rho_{salt}}.$$

Using the above equation, the acid capacity numbers for salt concentrations of 230 g/l and 150 g/l are calculated to be 0.06 and 0.097 respectively.

Figure 17:
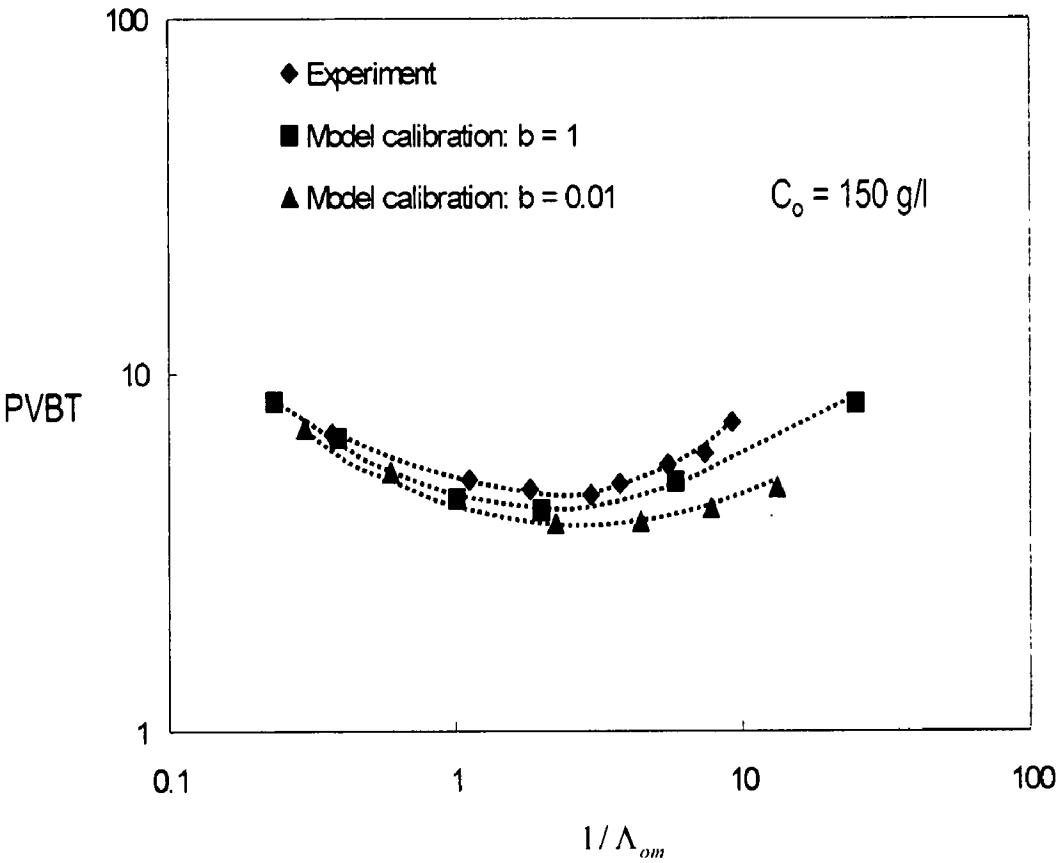
FIG. 17 is a plot showing the calibration of the model with experimental data for different structure property relations.
Figure 18:
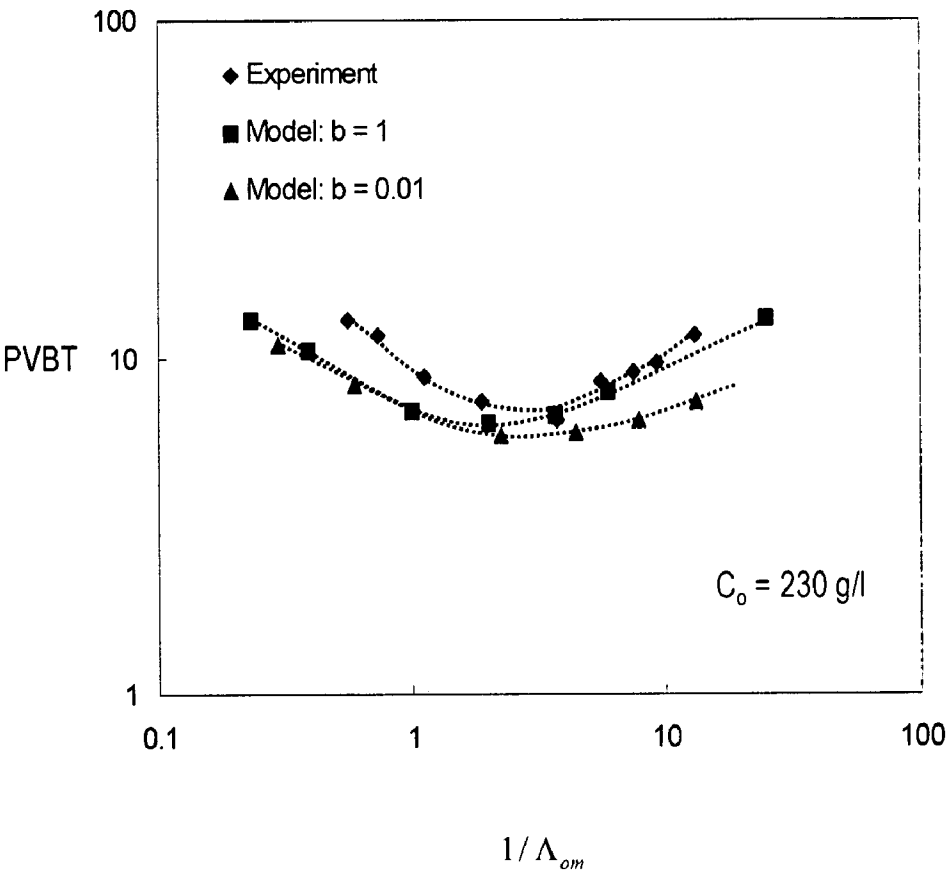
FIG. 18 compares different model predictions with experimental data for different structure property relations.

To compare model predictions with experimental data, information on initial average pore radius, interfacial area, and structure-property relations is useful. However, as this data is difficult to obtain directly, the model is calibrated with experimental data to obtain these parameters. Using these parameters, the model is simulated for a different set of experimental data for comparison. As described above, for mass transfer controlled reactions, the pore volumes of salt solution required to breakthrough is a function of the parameters $?_{om}$, $F^2_m$ and structure property relations for a given inlet concentration. The model is first calibrated to the breakthrough curve corresponding to the inlet salt solution concentration of 150 g/l. For calibration, the largest uncertainty arises from lack of information on structure-property relations, so the relation in Equation (50) is used with the value of b=1. The minimum pore volume to breakthrough depends on $F^2_m$ and its value is used to calibrate to the experimental minimum after the structure property relations are fixed. Then, the pore volume to breakthrough curve is generated for different values of $?_{om}$. FIG. 17 shows the calibration curve of the model with the experimental data. The value of $F_m$ used for calibration is 534. This value of $F_m$ is used to simulate the model for inlet salt concentration of 236 g/l ($N_{ac}$=0.06). The comparison of model predictions with experimental data is shown in FIG. 18. The value of $a_o/r_o$ can be calculated using Equation (45) and is found to be 912.49 $cm^{-2}$. Using this value of $a_o/r^o$ and the optimum value $?_{om}$=0.33, the value of injection velocity is calculated from Equation (47) to be $1.29\times10^{-3}$ cm/s ($D_m=2\times10^{-5}$ $cm^2$/s). This value is much lower when compared to the experimental optimum injection velocity $u_o$=0.045 cm/s. To get a better estimate of the injection velocity, a different value of b=0.01 is used for the structure-property relations and the model is calibrated with the data for inlet salt concentration of 150 g/l (see FIG. 17). The value of $F_m$ used for calibration is 1195. The model predictions for this value of b for inlet salt solution concentration of 230 g/l is shown in FIG. 18. The injection velocity is calculated using the procedure described before and is found to be $3\times10^{-3}$ cm/s. The above comparisons show that the model predictions in terms of pore volume are in reasonable agreement with experimental data.

To generalize, embodiments of the inventions use two-scale continuum models that retain the qualitative features of reactive dissolution of porous media. Some embodiments may use a two-dimensional version of the model to determine the influence of various parameters, such as the level of dispersion, the magnitude of heterogeneities, concentration of acid and pore scale mass transfer, on wormhole formation. The model predictions are in agreement with laboratory data on carbonate cores and salt-packs presented in the literature. It is shown hereinabove that the optimum injection velocity for wormhole formation is mainly determined by the effective rate constant $k_{eff}$ and the transverse dispersion coefficient $D_{eT}$. Models according to the invention may illustrate that wormholes are formed when the parameter $\Lambda=\sqrt{k_{eff}/D_{eT}}/u_o$ is in the range 0.1 to 1, while, for ?<<1, the dissolution may be uniform, and for ?>>1, face dissolution pattern may be obtained. The branching of wormholes increases with the magnitude of the heterogeneity but the pore volumes to breakthrough (PVBT) is nearly constant. The PVBT scales almost linearly with the acid capacity number. The pore scale mass transfer and reaction strongly influence the optimum injection rate and the PVBT. When the pore scale reaction is in the kinetic regime ($f^2$<<1), the structure-property relations may play a minor role in determining the optimum injection rate. However, in the mass transfer controlled regime ($f^2$>>1), both the optimum injection rate and PVBT are strongly dependent on the structure-property relations. Finally, it is described above that in the wormholing regime, the diameter of the wormhole scales inversely with the macroscopic Thiele modulus (F).

The model disclosed herein as well as the numerical calculations can be extended in several ways. Calculations herein indicate that the fractal dimension of the wormhole formed depends both on the magnitude of heterogeneity and the rate constant ($f^2$) Strong acids, such as HCl, and higher levels of heterogeneities, may produce thinner wormholes but having a higher fractal dimension. In contrast, weak acids and lower levels of heterogeneities can lead to fatter wormholes having lower fractal dimension. The models disclosed herein can be used to quantify the effect of wormholes of different fractal dimension and size on the overall permeability.

Models according to embodiments of the invention may be based upon linear kinetics and constant physical properties of treatment fluid, and may also be extended to include multi step chemistry at the pore scale as well as changing physical properties (e.g. viscosity varying with local pH) on wormhole structure. Likewise, all the calculations may be made used fixed or varied aspect ratios. The modes can be used to determine the density of wormholes by changing the aspect ratio corresponding to that near a wellbore (e.g. height of domain much larger than width).

The particular embodiments disclosed above are illustrative only, as the invention may be modified and practiced in different but equivalent manners apparent to those skilled in the art having the benefit of the teachings herein. Furthermore, no limitations are intended to the details of modeling or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of treating a subterranean formation comprising a porous medium, the method comprising:

a. modeling a subterranean formation stimulation treatment involving a chemical reaction between a treatment fluid introduced into the formation and the porous medium, the modeling generating a model of the stimulation treatment and comprising describing a growth rate and structure of a dissolution pattern formed due to injection of the treatment fluid in the porous medium, based on calculating length scales for dominant transport mechanism(s) and reaction mechanism(s) in a direction of flow $l_x$ and a direction transverse to flow $l_T$, wherein the growth rate and the structure of the dissolution pattern is described as function of $l_x$ and $l_T$ as follows:

$$\Lambda=(l_T/l_x)=\sqrt{(k_{eff}D_{eT})}/u_{tip}$$

whereby $k_{eff}$ is an effective rate constant, $D_{eT}$ is an effective transverse dispersion coefficient, and $u_{tip}$ is velocity of fluid at a tip of a wormhole, and whereby optimum flow rate for formation of wormholes is computed by setting $\Lambda$ in a range $0.1<\Lambda<5$; flow rate for uniform dissolution is computed by setting $\Lambda>0.001$; or, flow rate for face dissolution is computed by setting $\Lambda>5$;

b. introducing the treatment fluid into the formation; and c. treating the subterranean formation based upon the modeled stimulation treatment.

2. The method of claim 1, wherein the transport mechanism (s) is convection, dispersion or diffusion, of any of the components of the fluid or of the porous medium, or any combination thereof.

3. The method of claim 1, wherein the reaction mechanism (s) includes reactions between the components of the injected fluid and the porous medium.

4. The method of claim 1, wherein the porous medium comprises carbonate based minerals.

5. The method of claim 4, wherein the carbonate based minerals comprise calcite, dolomite, quartz, feldspars, clays, or any mixture thereof.

6. The method of claim 1, wherein the treatment fluid comprises mineral acids, organic acids, chelating agents, polymers, surfactants, or mixtures thereof.

7. The method of claim 1 wherein the model describes correlations for experimental data at one set of operating variables and subsequently applied to make predictions for a different set of operating variables, wherein the variable comprise temperature, concentration, pressure, flow rate, rock type, radial flow geometry, linear flow geometry, or any combination thereof.

8. The method of claim 1 wherein the model describes the impact of the magnitude and length scale of heterogeneity on the branching of wormholes, the pore volume of acid required to breakthrough the core (PVBT), or the scale-up of experimental data from one reservoir core to make predictions on reservoir cores with different type of heterogeneity.

9. The method of claim 1 wherein the model describes degree of wormhole branching as a function of magnitude of heterogeneity.

10. The method of claim 1 wherein the model describes optimum injection rate and the pore volume of acid required to breakthrough the core (PVBT) as a function of pore scale mass transfer and reaction

11. The method of claim 1 wherein the model describes that in a wormholing regime, diameter of the wormhole scales inversely with the macroscopic Thiele modulus, and directly with reciprocal of effective dissolution rate constant.

12. The method of claim 1 wherein the model describes matrix acidizing or hydraulic fracture treatments.

13. The method of claim 1 wherein the model describes a wormhole pattern.

14. The method of claim 1 wherein the model describes a face pattern.

15. The method of claim 1 wherein the model describes a conical pattern.

16. The method of claim 1 wherein the model describes a ramified pattern.

17. The method of claim 1 wherein the model describes a uniform pattern.

18. A method of treating a subterranean formation comprising a porous carbonate medium, the method comprising:

a. modeling a subterranean formation stimulation treatment involving a chemical reaction between a treatment fluid introduced into the formation and the porous carbonate medium, the modeling comprising describing a growth rate and structure of a wormhole pattern formed due to injection of the treatment fluid into the medium, based on calculating length scales for convection and/or dispersion transport mechanism(s) and heterogeneous reaction mechanism in a direction of flow $l_x$ and a direction transverse to flow $l_T$, wherein growth rate and structure of a dissolution pattern is described as function of $l_x$ and $l_T$ as follows:

$$\Lambda=(l_T/l_x)=\sqrt{(k_{eff}D_{eT})}/u_{tip}$$

whereby $k_{eff}$ is and effective rate constant, $D_{eT}$ is an effective transverse dispersion coefficient, and $u_{tip}$ is velocity of the fluid at a tip of the wormhole, and whereby optimum flow rate for formation of wormholes is computed by setting $\Lambda$ in a range $0.1<\Lambda<5$; flow rate for uniform dissolution is computed by setting $\Lambda<0.001$; or, flow rate for face dissolution is computed by setting $\Lambda>5$;

b. introducing the treatment fluid into the formation; and c. treating the subterranean formation based upon the modeled stimulation treatment.

19. A method of treating a subterranean formation comprising a porous medium, the method comprising:

a. modeling a subterranean formation stimulation treatment involving a chemical reaction between a treatment fluid introduced into the formation and the porous medium, the modeling comprising describing a growth rate and structure of a dissolution pattern formed due to injection of the treatment fluid in the porous medium, based on calculating length scales for dominant transport mechanism(s) and reaction mechanism(s) in a direction of flow $l_x$ and a direction transverse to flow $l_T$, wherein $l_x$ is determined by balancing the convection and reaction mechanism(s) $l_x \sim u_{tip}/k_{eff}$, whereby $k_{eff}$ is an effective rate constant, and $u_{tip}$ is velocity of the fluid at a tip of a wormhole;

b. introducing the treatment fluid into the formation; and c. treating the subterranean formation based upon the modeled stimulation treatment.

20. A method of treating a subterranean formation comprising a porous medium, the method comprising:

a. modeling a subterranean formation stimulation treatment involving a chemical reaction between a treatment fluid introduced into the formation and the porous medium, the modeling comprising describing a growth rate and structure of a dissolution pattern formed due to injection of the treatment fluid in the porous medium, based on calculating length scales for dominant transport mechanism(s) and reaction mechanism(s) in a direction of flow $l_x$ and a direction transverse to flow $l_T$, wherein $l_T$ is determined by balancing dispersion and reaction mechanism(s) $l_T \sim \sqrt{(D_{eT}/k_{eff})}$ whereby $k_{eff}$ is an effective rate constant and $D_{eT}$ is an effective transverse dispersion coefficient;

b. introducing the treatment fluid into the formation; and c. treating the subterranean formation based upon the modeled stimulation treatment.

* * * * *